US011718121B2

(12) United States Patent
Nash et al.

(10) Patent No.: US 11,718,121 B2
(45) Date of Patent: Aug. 8, 2023

(54) SPIRAL-SHAPED ADHESIVE NOTEPADS AND METHODS AND DEVICES FOR MAKING THEM

(71) Applicant: 3M INNOVATIVE PROPERTIES COMPANY, St. Paul, MN (US)

(72) Inventors: James E. Nash, Bloomington, MN (US); Douglas P. Bodziak, Lake Elmo, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 127 days.

(21) Appl. No.: 17/294,515

(22) PCT Filed: Nov. 8, 2019

(86) PCT No.: PCT/IB2019/059617
§ 371 (c)(1),
(2) Date: May 17, 2021

(87) PCT Pub. No.: WO2020/104883
PCT Pub. Date: May 28, 2020

(65) Prior Publication Data

US 2022/0016922 A1 Jan. 20, 2022

Related U.S. Application Data

(60) Provisional application No. 62/770,254, filed on Nov. 21, 2018.

(51) Int. Cl.
*B42D 5/00* (2006.01)

(52) U.S. Cl.
CPC ..... *B42D 5/005* (2013.01)

(58) Field of Classification Search
CPC ..... B42D 5/005; B42D 5/003; B42D 5/00
(Continued)

(56) References Cited

U.S. PATENT DOCUMENTS 3,691,140 A 9/1972 Silver
3,857,731 A 12/1974 Merrill, Jr.
(Continued)

FOREIGN PATENT DOCUMENTS

DE 60100803 7/2004
WO WO 2013-101808 7/2013

OTHER PUBLICATIONS

International Search Report for PCT International Application No. PCT/IB2019/059617, dated Jun. 16, 2019, 6 pages.

*Primary Examiner* — Justin V Lewis
(74) *Attorney, Agent, or Firm* — Vincent Pham

(57) ABSTRACT

A notepad includes multiple sheets that are arranged into a stack. Each sheet has a first major face, a second major face, and a perimeter edge at which each of the first and second major faces terminate. The notepad also includes an adhesive disposed on a portion of the second major face of each sheet such that the portion of the second major face of each sheet releasably adheres to a corresponding portion of the first major face of an underlying sheet. The portion being disposed with the adhesive lies adjacent to a portion of the perimeter edge of a corresponding sheet for forming a releasably bonded side of the stack. Also, the stack is twisted about a common central axis of the sheets present therein such that the notepad has a spiral shape.

18 Claims, 19 Drawing Sheets

(58) Field of Classification Search
USPC ..... 40/726; 281/3.1, 5, 10, 12, 15.1, 44, 45; 283/62, 63.1
See application file for complete search history.

(56) References Cited

U.S. PATENT DOCUMENTS

| | | | | | |
|---|---|---|---|---|---|
| 4,166,152 | A | | 4/1979 | Baker | |
| 4,786,696 | A | | 11/1988 | Bohnel | |
| 4,969,665 | A | * | 11/1990 | Thiaville | B42D 5/003 283/117 |
| 4,988,567 | A | | 1/1991 | Delgado | |
| 4,994,322 | A | | 2/1991 | Delgado | |
| 5,045,569 | A | | 9/1991 | Delgado | |
| 6,874,774 | B2 | | 4/2005 | Todie | |

* cited by examiner

SPIRAL-SHAPED ADHESIVE NOTEPADS AND METHODS AND DEVICES FOR MAKING THEM

CROSS REFERENCE TO RELATED APPLICATIONS

This application is a national stage filing under 35 U.S.C. 371 of PCT/IB2019/059617, filed 8 Nov. 2019, which claims the benefit of U.S. Provisional Application No. 62/770,254, filed 21 Nov. 2018, the disclosures of which are incorporated by reference in their entireties herein.

TECHNICAL FIELD

The present disclosure relates to spiral-shaped pads of repositionable adhesive notes and to devices and methods that can be used for producing the spiral-shaped pads of repositionable adhesive notes.

BACKGROUND

Notepads are commonly known. In conventional methods of producing a notepad, multiple similarly shaped and sized sheets of paper are stacked one above the other, and a padding compound is applied to one vertical side of the stack to bind the sheets of paper securely together along one of their perimeter edges. During use, the topmost sheet (or sheets) of paper can be easily separable from the stack by peeling the topmost sheet (or sheets) off of the stack. Notepads having a spiral shape are known. Such notepads include padding compound along one perimeter edge and have a generally spiral shape.

Conventionally, when a notepad is manufactured, a plurality of sheets are first arranged into a stack. One side of this stack is applied with a padding compound to releasably bind together the plurality of sheets for forming the notepad. A period of curing typically follows the application of the padding compound. This curing period is required for the applied padding compound to cure so that individual sheets in the stack are prevented from inadvertently separating from the stack. However, the curing period also entails that the unfinished notepad may need to remain within a premise of a curing facility until the padding compound cures.

Repositionable adhesive notes are also commonly known. These are generally pads or stacks of paper each including a re-adherable strip of glue on its back major surface covering approximately ½-⅛ of the surface area of the individual note. The adhesive strip is adjacent to one of the perimeter edges (meaning that the adhesive strip is adjacent to at least one edge of the note. These adhesive notepads are often referred to as "adhesive notes" or "sticky notes". The strip of adhesive permits the paper to be attached to documents and other surfaces. The strip of adhesive also permits the paper to attach to the strip of paper below is in the stack, eliminating the need for padding compound when forming a notepad or stack of adhesive notes. In many embodiments, the adhesive notes are repositionable (meaning that they can be attached, detached, and reattached in a different location multiple times). Further, in many embodiments, the adhesive notes can be easily attached, removed, and re-positioned without leaving a residue. One commercially available example of adhesive notes are those sold under the Post-it™ brand.

SUMMARY

The inventors of the present disclosure recognized the pleasing aesthetics of spiral shaped notepads and the tremendous value in adhesive notes. The inventors thus sought to create a spiral-shaped adhesive notepad. The advantages of such an article are many and include the following. The resulting article has excellent aesthetic design as well as tremendous practical use. Further, the form factor of conventionally designed notepads where the edges of the individual sheets of the notepad align with one another is poor for many users because users may find it difficult to pick apart and separate individual sheets from such notepads. In contrast, the inventors of the present disclosure recognized that spiralizing the adhesive notes of the notepad makes it much easier for users to hold a single sheet of paper and to separate it from adjacent sheets of paper.

However, it is technically challenging to spiralize adhesive notes because the notes are adhered to one another by the adhesive. Spiralizing such adhesive notes causes the notes to pull away from one another, which can negatively impact the adhesive and/or the shape of the notepad. One prior art attempt to spiralize adhesive notes is described in U.S. Pat. No. 4,969,665. This reference requires that the adhesive be coated "at the center of the sheet" (col. 2, lines 22-25) so that the adhesive notes can be effectively spiralized. However, notes with a relatively small amount of adhesive at their center have more limited usefulness than standard adhesive notes having an adhesive strip adjacent to a perimeter edge of the note and/or occupying between about ⅛ and about ½ of the surface area of the note.

The inventors of the present disclosure thus invented a spiralized adhesive notepad with adhesive adjacent to a perimeter edge of the notepad and a padding compound along that perimeter edge.

Further, the inventors of the present disclosure recognized that when making spiralized notepads, manufacturing cost can be high because the notepads have to cure for a prolonged period of time in the equipment that forms their spiral shape. During this period of curing, the notepad is in an unfinished in state and hence, unfit for use. If the curing process is rushed (for example, by removing the spiralized notepad too early from its spiralizing equipment), the padding compound may not be fully cured and there may be a possibility that one or more sheets can inadvertently separate from a rest of the stack. However, leaving the spiralized notepads in the spiralizing equipment increases costs, lengthens manufacturing time, and reduced total output of manufacturing equipment.

So, the inventors of the present disclosure invented various spiralizing manufacturing devices and manufacturing methods that can both spiralize notepads as well as act as the notepad packaging. The notepads can thus cure in the spiralizing equipment during transit, storage in distribution centers, and potentially while on retail shelves. This increases throughput and can reduce manufacturing cycle time.

Some embodiments of the present disclosure relate to an adhesive notepad having a plurality of sheets of paper arranged in a stack. The stack includes a first (top) major surface and a second (bottom) major surface and one or more perimeter edges or sides extending between the top major surface and the bottom major surface. Similarly, each sheet in the stack has a first (top) major face, a second (bottom) major face, and one or more perimeter edges or sides at which each of the first and second major faces terminate. In some embodiments, each sheet also includes an adhesive disposed on a portion of the second major face such that the adhesive portion of the second major face of each sheet releasably adheres to a corresponding portion of the first major face of an underlying sheet. In some embodiments, the adhesive portion of each sheet is directly adjacent to at least a portion of the perimeter edge of the sheet. In some embodiments, the adhesive portion of each sheet is directly adjacent to one side surface of the stack and/or sheet of paper. In some embodiments, the adhesive notepad stack is twisted about a common central axis of the plurality of sheets present therein such that the notepad has a spiral shape. In some embodiments, the adhesive notepad stack includes a padding compound along one of the perimeter edges and/or sides of the notepad stack.

Some embodiments of the present disclosure relate to a device for holding a spiral-shaped notepad having multiple sheets that are arranged into a stack. In some embodiments, the device includes a first holding portion that is configured to hold a first distal portion of the notepad, and a second holding portion that is configured to hold a second distal portion of the notepad. In some embodiments, the second holding portion is at least one of integrally formed with and capable of being connected to the first holding portion. In some embodiments, the device is used in packaging the spiral-shaped notepad for sale to a user. In some embodiments, the notepad is an adhesive notepad. In some embodiments, the notes include a strip of adhesive that is adjacent to at least one perimeter edge and/or side of the notepad or note.

Some embodiments of the present disclosure relate to a method for producing a spiral-shaped notepad. In some embodiments, the method includes providing a notepad having multiple sheets arranged into a stack such that the stack has a first distal portion and a second distal portion. In some embodiments, the method further includes providing a device that has a first holding portion and a second holding portion such that the first holding portion and the second holding portion are located along a common central axis. In some embodiments, the method then includes positioning the first distal portion of the notepad such that the first distal portion is held by the first holding portion of the device. In some embodiments, the method also includes positioning the second distal portion of the notepad such that the second distal portion is held by the second holding portion of the device. In some embodiments, the method also includes twisting the notepad about the central axis for forming the spiral-shaped notepad. In some embodiments, the notepad is an adhesive notepad. In some embodiments, the notes include a strip of adhesive that is adjacent to at least one perimeter edge and/or side of the notepad or note.

BRIEF DESCRIPTION OF THE DRAWINGS

Exemplary embodiments disclosed herein may be more completely understood in consideration of the following detailed description in connection with the following figures. The figures are not necessarily drawn to scale. Like numerals used in the figures refer to like components. When pluralities of similar elements are present, a single reference numeral may be assigned to each plurality of similar elements with a small letter designation referring to specific elements. When referring to the elements collectively or to a non-specific one or more of the elements, the small letter designation may be eliminated. However, it will be understood that the use of a numeral to refer to a component in a given figure is not intended to limit the component in another figure labeled with the same number.

DETAILED DESCRIPTION

In the following description, reference is made to the accompanying figures that form a part thereof and in which various embodiments are shown by way of illustration. It is to be understood that other embodiments are contemplated and may be made without departing from the scope or spirit of the present disclosure. The following detailed description, therefore, is not to be taken in a limiting sense.

In the present disclosure, where multiple sheets are arranged one above another in stacked form to form part of a notepad, such an arrangement may be referred to using the term "stack."

In the context of present disclosure, the terms "first" and "second" are used as identifiers. Therefore, such terms should not be construed as limiting of this disclosure. The terms "first" and "second" when used in conjunction with a feature or an element can be interchanged throughout the embodiments of this disclosure.

The present disclosure relates to spiralized adhesive notepads having a plurality of sheets that are arranged into a stack. Further, the present disclosure also relates to devices for making and/or holding a spiral-shaped notepad. In some embodiments, the device includes (1) a first holding portion that is configured to hold a first distal portion of the stack and (2) a second holding portion that is configured to hold a second distal portion of the stack. In some embodiments, the second holding portion is integrally formed with and/or capable of being connected to the first holding portion. In some embodiments, the device is used in packaging the spiral-shaped notepad for sale to a user.

Figure 1:
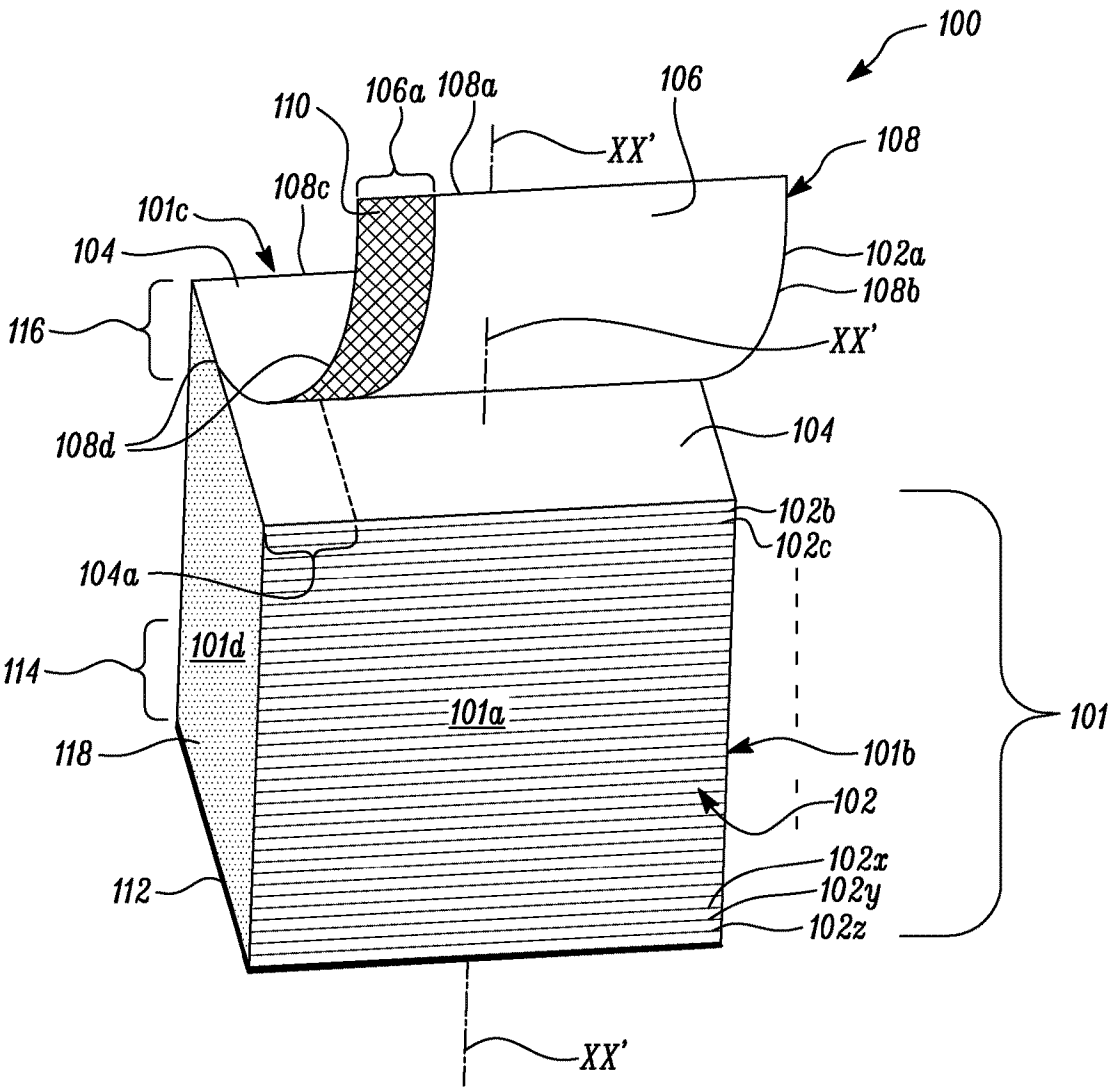
FIG. 1 is a schematic top perspective view of a notepad that can be used to form a spiral-shaped notepad according to an embodiment of the present disclosure.

The spiral-shaped notepad according to the present disclosure can be used as a stationery supply or item. One exemplary embodiment of a spiralized adhesive notepad 100 is illustrated in FIG. 1. The notepad 100 has multiple sheets 102*a*, 102*b*, 102*c*, . . . and 102*z* that are arranged into a stack 101. Each sheet 102 has a first major face 104, a second major face 106, and one or more perimeter edges (or sides) 108 at which each of the first and second major faces 104, 106 terminate. In the accompanying drawings, the perimeter edge 108 of each sheet 102 of the notepad 100 is shown shaped to have four edges 108*a*-108*d* thereby rendering the stack 101 with four sides 101*a*-101*d* when individual sheets 102*a*, 102*b*, 102*c*, . . . and 102*z* are stacked one above another. A number of edges present in the perimeter edge 108 of the individual sheets 102 forming the stack 101 and a resulting number of sides in the formed stack 101 are merely exemplary in nature, and hence, non-limiting of this disclosure. In some embodiments, notepads of the present disclosure can have three, four, five, six, or more sides. For example, each sheet may have a perimeter edge comprising five edges i.e., the sheets and stack or notepad may have a pentagonal or pentaprismatic shape. As another example, each sheet may have a perimeter edge comprising three edges i.e., the sheets and stack or notepad may have a triangular shape.

Further, as shown in FIG. 1, the adhesive notepad 100 also includes an adhesive 110 disposed on a portion of the second major face 106 of each sheet 102 such that the portion of the second major face 106 of each sheet 102, for example, the sheet 102*a* releasably adheres to a corresponding portion 104*a* of the first major face 104 of an underlying sheet 102, for example, the sheet 102*b*. The portion of the second major surface 106 of each sheet 102 being disposed with the adhesive 110 lies directly adjacent to at least a portion of the perimeter edge 108 of the sheet and/or directly adjacent to a side of the notepad or stack 100. In some embodiments, the portion of the perimeter edge 108 of each sheet 102 forms a releasably bonded side of the stack 101. In the embodiment of FIG. 1, the portion of the second major face 106 of the sheet 102 that is disposed with the adhesive 110 is denoted as 106*a*. This portion 106*a* is located adjacent to a portion of the perimeter edge 108 as represented by the edge 108*d* for forming the releasably bonded side of the stack 101 i.e., the side 101*d* of the stack 101. This pattern of application of the adhesive 110 may be consistently followed for each sheet 102 present in the stack 101 excluding, for example and where present, a backing board or article 112 disposed underneath the last sheet 102*z* of the stack 101. However, it may be noted that in other embodiments, other portions of the second major face 106 located adjacent to corresponding pre-determined portions of the perimeter edge 108 may be disposed with the adhesive 110 to suit specific requirements of an application.

The adhesive 110 disclosed herein is preferably a repositionable pressure sensitive adhesive (RPSA). Useful RPSAs are those that exhibit repositionable, removable characteristics. In this context, the term "repositionable" means that the sheet can be adhered to and removed from a clean solid surface at least two times without substantially losing tack. Preferably, the sheet 102 can be adhered to and removed from a clean solid surface at least ten times, and more preferably, at least twenty times, without substantially losing tack. RPSAs are well known in the art as evidenced by U.S. Pat. Nos. 5,045,569; 4,988,567; 4,994,322; 4,786,696; 4,166,152; 3,857,731; and 3,691,140, the disclosures of each of which are incorporated herein in their entirety by reference. A RPSA typically comprises polymeric microspheres having an average diameter of at least about one micrometer. The microspheres are inherently tacky and typically comprise at least about 70 parts by weight of an alkyl acrylate or alkyl methacrylate ester. A majority of the microspheres may contain interior voids, typically, at least about 10 percent of the diameter of the microsphere. RPSAs are tacky to the touch and typically demonstrate a peel adhesion of approximately 10 to 300 gram/centimeters (g/cm), more typically approximately 50 to 250 g/cm, and even more typically about 70 to 100 g/cm. Peel adhesion can be determined according to the test outlined in U.S. Pat. No. 5,045,569. The RPSA can be applied to a sheet using known methods including making a suspension of the microspheres and applying that suspension to the sheet by conventional coating techniques such as knife coating or Meyer bar coating or use of an extrusion dye (see U.S. Pat. No. 5,045,569 at column 7, lines 40-50). Other methods to create repositionable adhesive coatings are well known in the art and may include printing a fine pattern of adhesive dots; selective detoxification of an adhesive layer; and incorporating non-tacky microspheres in an adhesive matrix. Other useful adhesives include high peel adhesives that may permanently attach a sheet. Examples of such adhesives include rubber resin and acrylic adhesives.

Furthermore, in some embodiments herein, the adhesive 110 is disposed on about 10% to about 75% of the total surface area of the second major face 106 of the sheet 102. In some embodiments, at least about 10% or about 15% or about 20% or about 25% or about 30% or about 40% or about 45%, or about 50%, or about 55%, or about 60%, or about 65%, or about 70% of the total surface area of the second major surface 106 may include adhesive 110 thereon. In some embodiments, less than about 75% or less than about 70%, or less than about 65%, or less than about 60%, or less than about 55%, or less than about 45% or less than about 40% or less than about 35% or less than about 30% or less than about 25% or less than about 20% or less than about 15% of the total surface are of the second major surface 106 may include adhesive 110 thereon. In some embodiments, the adhesive is patterned or includes discontinuities or gaps. In some embodiments where the adhesive is patterned or includes discontinuities or gaps, the adhesive area that is patterned or to which adhesive is applied extends over the entire second major face 106 of the sheet 102 but the discontinuities or gaps in adhesive result in the actual surface area coverage to be less than about 75% of the total surface area of the second major face 106 of the sheet 102. In this way, seemingly "full adhesive" notes can be spiralized.

In the embodiment shown in FIG. 1, the stack 101 has a first distal portion 114 and a second distal portion 116. In embodiments herein, the terms "first distal portion" and "second distal portion 116" can be regarded as being inclusive of a first distally located sheet in the stack 101, for example, sheet 102*z* and a second distally located sheet, for example, sheet 102*a* respectively. As such, the terms "first distal portion" and "second distal portion 116" used throughout this application may also be used to refer to a sub-stack 101 of sheets located at an extreme portion of the stack 101, for example, a sub-stack comprising the sheets . . . 102*x*, 102*y*, and 102*z* and a sub-stack comprising the sheets 102*a*, 102*b*, 102*c* . . . respectively.

Moreover, in embodiment of FIG. 1, the notepad 100 also includes a padding compound 118 that is applied on the sheets of the stack 101. Specifically, the padding compound 118 is on at least the portion, i.e., the edge 108*d* forming, in part, the perimeter edge 108 of each sheet 102 that forms the releasably bonded side i.e., the side 101*d* of the stack 101. The padding compound 118 is used to bind together the sheets at the releasably bonded side 101*d* of the stack 101 while also rendering individual sheets 102 of the stack 101 in a manner separable of one another. The padding compound can be on the same edge or side of the stack as the adhesive or on another edge or side.

Figure 2:
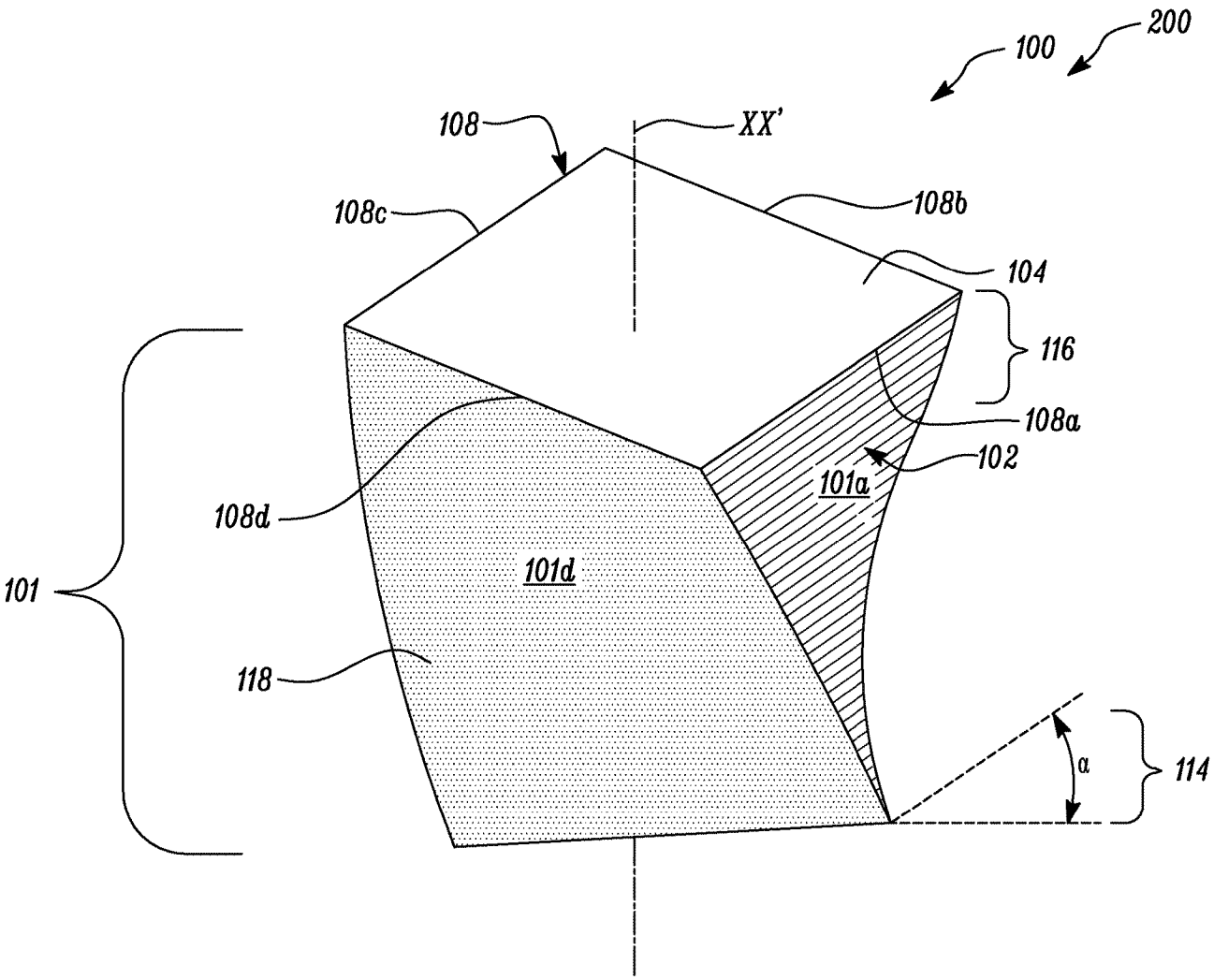
FIGS. 2-3 are schematic top perspective views of a spiral-shaped notepad formed from twisting the notepad of FIG. 1 about a central axis of a plurality of sheets present in the notepad according to an embodiment of the present disclosure.
Figure 3:
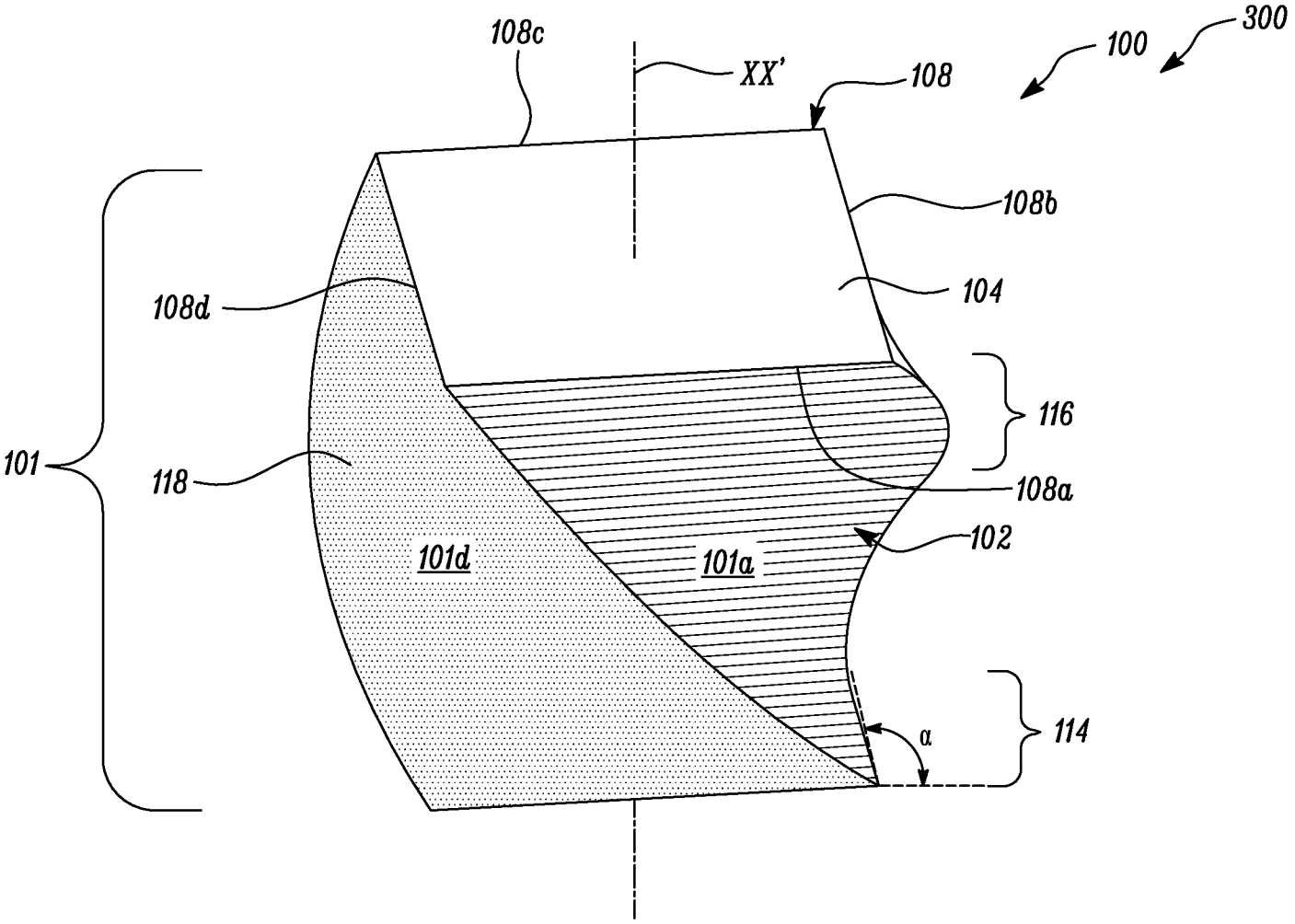

As shown in FIGS. 2 and 3, the stack 101 is twisted about a common central axis XX' of the sheets 102 present therein such that the notepad 200/300 has a spiral shape. In other words, as shown in the views of the spiral-shaped notepads 200/300 of FIGS. 2 and 3 respectively, the first distal portion 114 and the second distal portion 116 of the stack 101 are offset from one another by a pre-determined angle 'α', the pre-determined angle 'α' being measured in a plane perpendicular to the central axis XX'. In the view of FIG. 2, the pre-determined angle 'α' between the first and second distal portions 114, 116 of the spiral-shaped notepad 200 may be, for example, 45 degrees. In another instance, the pre-determined angle 'α' between the first and second distal portions 114, 116 may be, for example, 90 degrees, as shown in the view of the spiral-shaped notepad 300 of FIG. 3. Further, in embodiments herein, upon twisting the stack 101 about the central axis XX', the stack 101 is maintained in its twisted state for a pre-determined amount of time. This pre-determined amount of time may be in the range of 1 hour to 24 hours. In some embodiments, the pre-determined amount of time is in the range of about 2 hours to about 8 hours, or about 3 hours to about 6 hours. As disclosed earlier, the padding compound 118 may be applied to bind each sheet 102 at the releasably bonded side i.e., the side 101*d* of the stack 101. The pre-determined amount of time for which the stack 101 is maintained in its twisted state may correspond to a time duration that is sufficient to allow the padding compound 118 to cure and subsequently retain the spiral shape of the notepad for forming the spiral-shaped notepad 200/300 of FIG. 2 or 3 respectively. Although two spiral-shaped notepads 200/300 are disclosed herein, for sake of simplicity, explanation to various embodiments of the present disclosure will be made in conjunction with production of the spiral-shaped notepad 300 of FIG. 3. Nonetheless, some specific embodiments in the following description will be explained in conjunction with the production of the spiral-shaped notepad 200 of FIG. 2 as well.

The present disclosure also relates to various devices for producing a spiral-shaped notepad. In some embodiments as shown in the views of FIGS. 4A-4F, 5A-5F, and 6A-6F respectively, the devices 400, 500, and 600 may be used for forming as well as holding the spiral-shaped notepad 300. Further, in the specific embodiment shown in the view of FIGS. 4A-4F, the device 400 can be used for forming as well as holding the spiral-shaped notepad 200. Furthermore, it will be appreciated that the device 400 disclosed in conjunction with FIGS. 4A-4F can also be used to package the spiral-shaped notepad 200 of FIG. 2 as well. In other embodiments as shown in the views of FIGS. 7A-7F and 8A-8E respectively, the devices 700, 800 may be used for holding the spiral-shaped notepad 300 therein. Regardless of whether the devices 400, 500, 600, 700, and 800 disclosed herein form the spiral-shaped notepad 300, the devices 400, 500, 600, 700, and 800 of the present disclosure can be used in the packaging of the spiral-shaped notepad 300 for sale to a user. In some embodiments the spiral-shaped notepads include adhesive on at least a portion of the notepad to form an adhesive note and/or adhesive notepad. In other embodiments, the spiral-shaped notepads do not include adhesive on the sheets of paper in the notepad.

In an embodiment as shown in FIGS. 4A through 4F, a device 400 that can be used for holding and forming the spiral-shaped notepad 200/300 is depicted. The device 400 includes a first holding portion 402 and a second holding portion 404. The first holding portion 402 is configured to hold the first distal portion 114 of the stack 101 and the second holding portion 404 is configured to hold the second distal portion 116 of the stack 101 as evident from the views of FIGS. 4B and 4C. In this embodiment, the second holding portion 404 is capable of being connected to the first holding portion 402. Moreover, in the illustrated embodiment of FIGS. 4A-4F, the first holding portion 402 and the second holding portion 404 are together configured to form a container 406. The container 406 has a base 408, a cylindrical wall 410 extending upwardly from the base 408, and a lid 412 having an end wall 414 and a cylindrical lip 416 depending downwardly from the end wall 414. The cylindrical lip 416 of the lid 412 is configured to releasably engage with the cylindrical wall 410 of the container 406 and this lid 412 is rotatable in relation to the cylindrical wall 410 to twist the stack 101 about the central axis XX' for obtaining the spiral-shaped notepad.

Specifically, in this embodiment, the base 408 forms the first holding portion 402 while the lid 412, and in particular, the end wall 414 of the lid 412 forms the second holding portion 404. Further, an inner surface 418 of the first holding portion 402 i.e., the base 408 includes a receptacle 420 that is configured to hold the first distal portion 114 of the stack 101 therein, and an inner surface 422 of the second holding portion 404 i.e., the end wall 414 of the lid 412 includes another receptacle 424 that is configured to hold the second distal portion 116 of the stack 101 therein. The receptacle 420 of the first holding portion 402 is bound by at least one protrusion 426 that is located on the inner surface 418 of the first holding portion 402. The receptacle 424 of the second holding portion 404 is bound by at least one other protrusion 428 that is located on the inner surface 422 of the second holding portion 404. In an embodiment as shown in FIGS. 4A-4F, the at least one protrusion on inner surfaces 418, 422 of corresponding ones of the first and second holding portions 402, 404 includes multiple discreet protrusions that are arranged about the central axis XX'. As shown in the illustrated embodiment of FIGS. 4B-4F, the base 408 includes four protrusions 426*a*-426*d* and the end wall 414 of the lid 412 includes four protrusions 428*a*-428*d*, each set of four protrusions 426*a*-426*d* and 428*a*-428*d* from corresponding ones of the base 408 and the end wall 414 of the lid 412 are arranged in a quadrilateral configuration about the central axis XX' to correspond with a number of sides associated with the stack 101 i.e., the four sides of the stack 101. However, it may be noted that the four protrusions 426*a*-426*d* and 426*a*-426*d* that are shown on each of the base 408 and the end wall 414 of the lid 412 in the views of FIGS. 4A-4F are non-limiting of this disclosure. In an alternative embodiment, the at least one protrusion 426, 428 on the inner surfaces 418, 422 of corresponding ones of the first and second holding portions 402, 404 may include a single contiguous protrusion (not shown) that is arranged in a, for example, quadrilateral configuration about the central axis XX' to correspond with the four sides of the stack 101. If the sheets 102 of the stack 101 are characterized with a perimeter edge of another polygonal shape, for example, a pentagonal shape, the contiguous protrusion on the inner surfaces 418, 422 of each of the first and second holding portions 402, 404 may be rendered to conform to a resulting shape of the stack 101. In yet another alternative embodiment, the base 408 may include two protrusions, for example, the protrusions 426*a* and 426*c* while the end wall 414 of the lid 412 also includes another two protrusions, for example, 428*b* and 428*d* to correspond with the sides 101*a*-101*d* of the stack 101. Further, in yet other embodiments, fewer or more protrusions may be present in each of the first and second holding portions 402, 404 to correspond with one or more pre-determined number of sides of the stack 101.

Figure 4B:
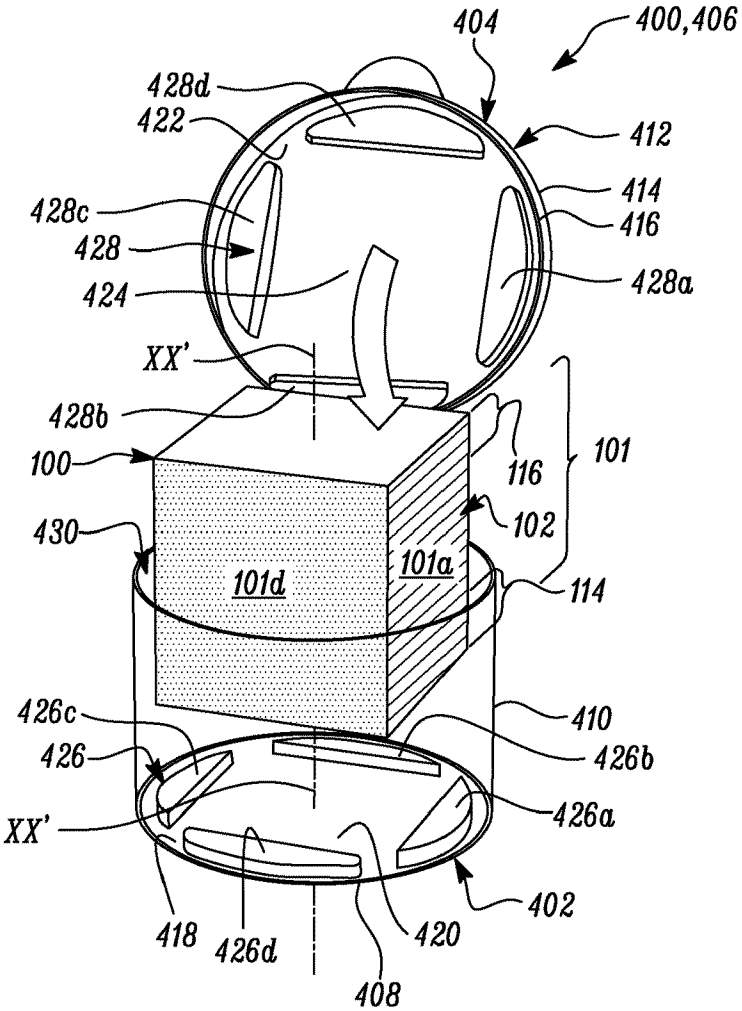
FIGS. 4A-4F are various schematic views of a device for forming and holding the spiral-shaped notepad of FIG. 2 or 3 according to one embodiment of the present disclosure.
Figure 4A:
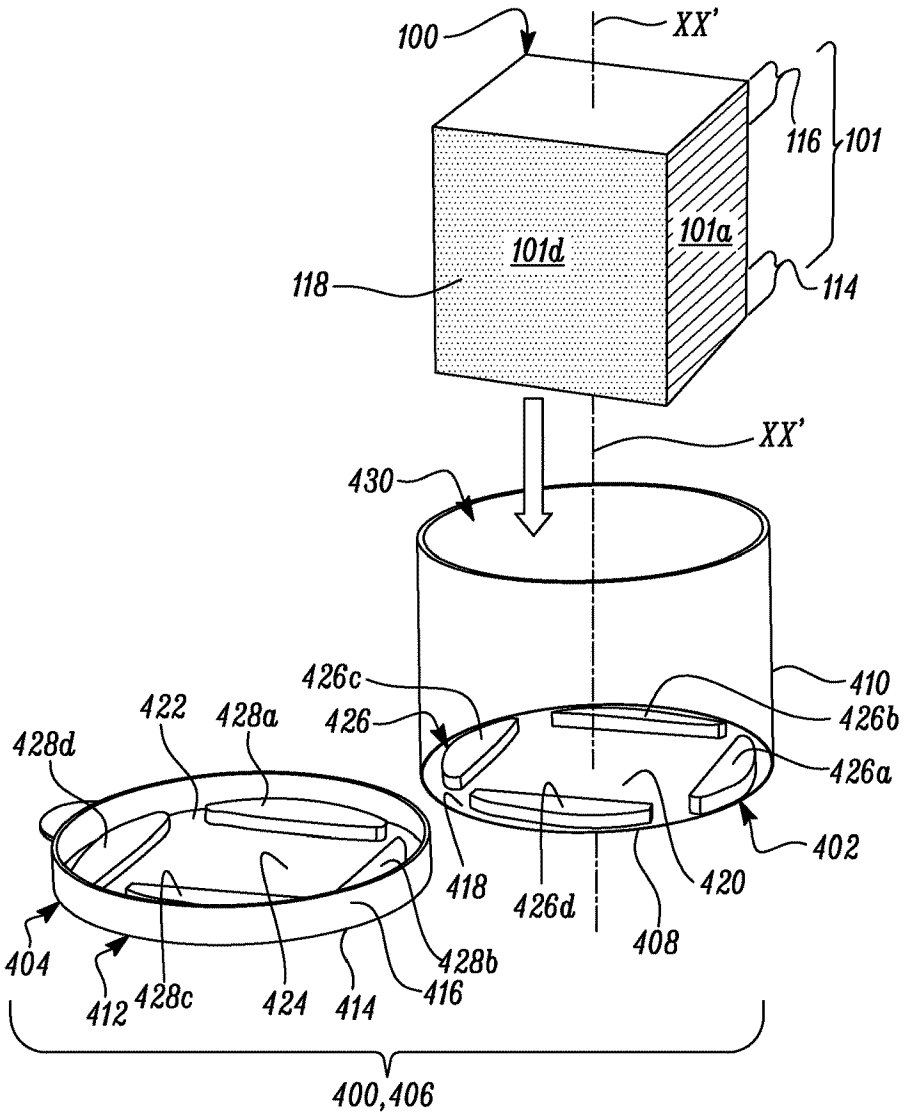

As shown in FIG. 4B, the stack 101 of sheets 102 forming the notepad 100 is received within an opening 430 defined by the cylindrical wall 410 of the container 406. Further, as shown in the view of FIG. 4C, the first distal portion 114 of the stack 101 is positioned within the receptacle 420 of the base 408. Furthermore, the lid 412 is closed over the opening 430 defined the cylindrical wall 410. Specifically, as shown in the view of FIG. 4C, the lid 412 may be closed over the opening 430 of the cylindrical wall 410 of the container 406 such that the second distal portion 116 of the stack 101 is positioned within the receptacle 424 on the end wall 414 of the lid 412. Upon connecting the first and second holding portions 402, 404 to one another, the device 400 is capable of maintaining the notepad therein. Moreover, in this embodiment, the first holding portion 402 and/or the second holding portion 404 i.e., the base 408 and/or the lid 412 are rotatable relative to one another about the central axis XX' for twisting the stack 101 about the central axis XX' and for forming the spiral-shaped notepad. In this embodiment, the first holding portion 402 and/or the second holding portion 404 i.e., the base 408 and/or the lid 412 are rotatable relative to one another by at least 1 degree to 359 degrees for forming a spiral-shaped notepad such that the first and second distal portions 114, 116 of the formed spiral-shaped notepad are offset from one another by an angle of 1 degree to 359 degrees. Referring to the view of FIG. 4D, the stack 101 is shown in a state of being twisted about the common central axis XX' of the sheets 102 present therein such that the notepad has a spiral shape. The device 400 may be left to remain in this state i.e., with the relative positioning of the lid 412 and the base 408 depicted in the view of FIG. 4D for forming the spiral-shaped notepad of FIG. 2 having the first and second distal portions 114, 116 offset from one another at the pre-determined angle of, for example, 45 degrees. Moreover, in embodiments herein, the first and second holding portions 402, 404, once connected to one another, are capable of maintaining the notepad in its spiral shape. In this embodiment, the cylindrical lip 416 of the lid 412 and the cylindrical wall 410 of the container 406 are configured to act as restraints, for example, by engaging with one another to prevent any inadvertent relative movement between the cylindrical lip 416 and the cylindrical wall 410 along, and about, the central axis XX'. In this manner, the cylindrical lip 416 and the cylindrical wall 410 are capable of co-operatively maintaining the notepad in its spiral shape. As disclosed earlier herein, the padding compound 118 is applied to the releasably bonded side i.e., the side 101*d* of the stack 101 that extends transversely between the first and second holding portions 402, 404. Specifically, this padding compound 118 is applied to the releasably bonded side of the stack 101 prior to twisting the stack 101 about the central axis XX', preferably, before the stack 101 is received within the opening 430 of the container 406. By leaving the first and second holding portions 402, 404 to remain in their rotated states, as depicted in the view of FIG. 4D, for the pre-determined period of time, the padding compound 118 can cure and upon lapse of the pre-determined period of time, the cured padding compound 118 can help retain the spiral shape of the notepad for forming the spiral-shaped notepad of FIG. 2.

Figure 4D:
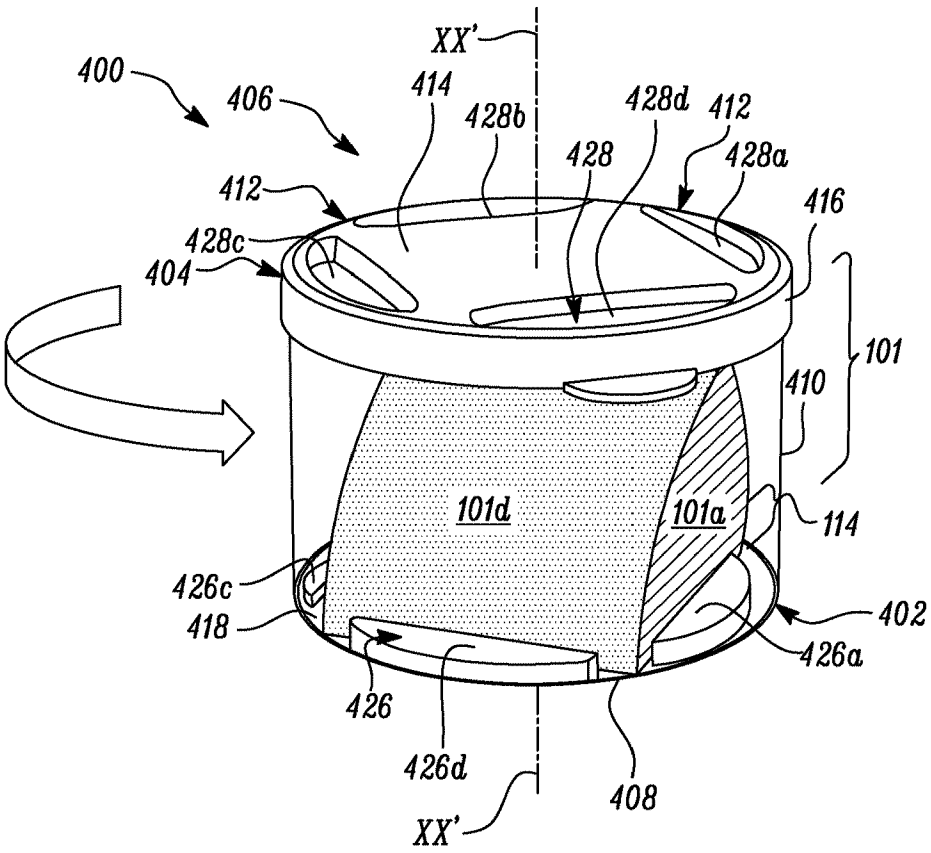
Figure 4C:
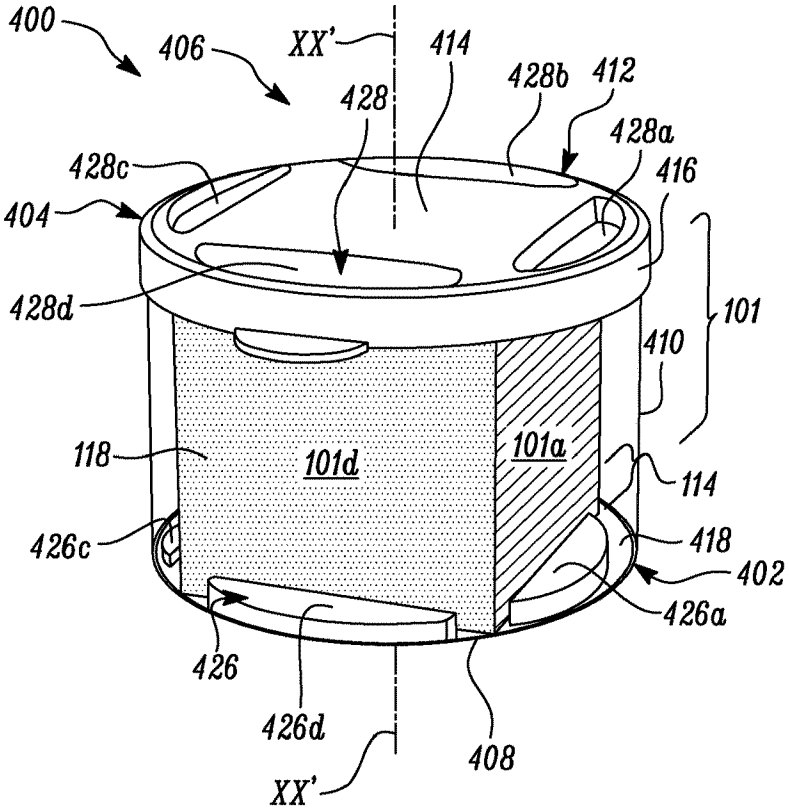
Figure 4F:
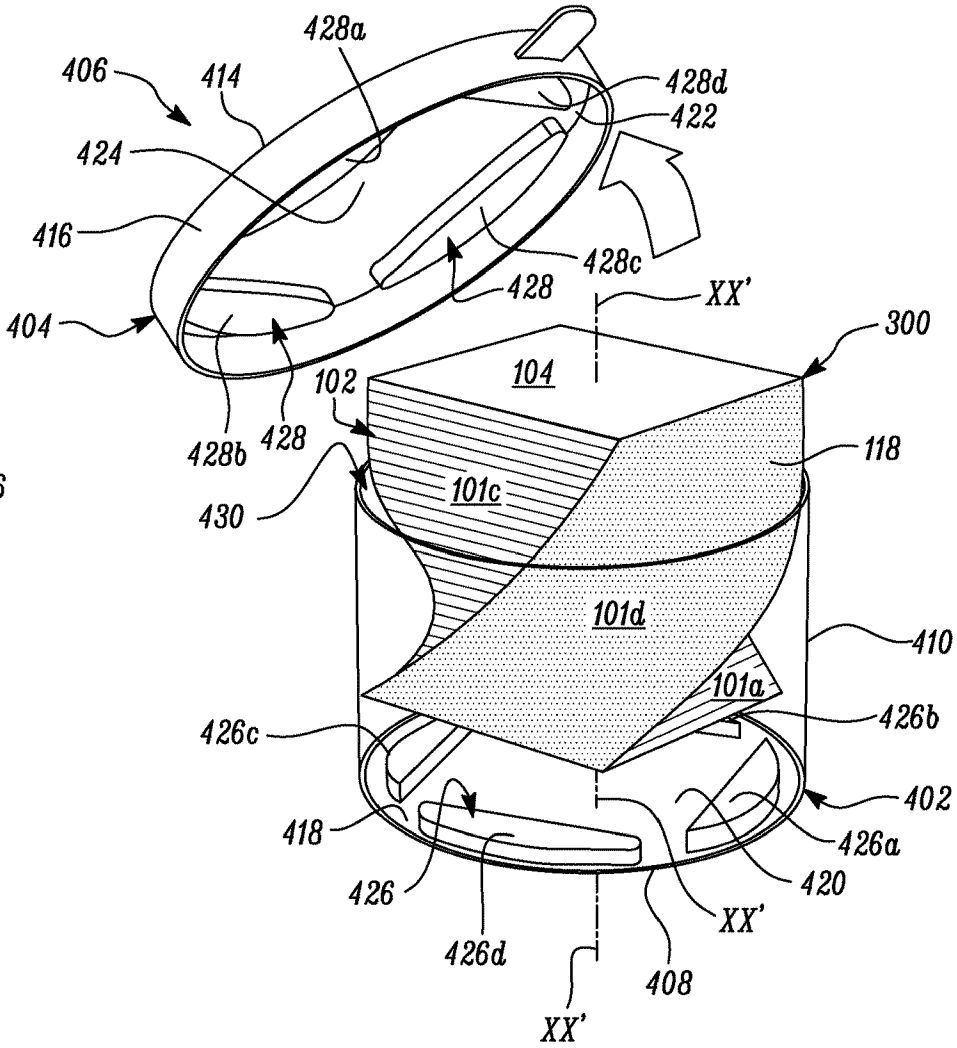
Figure 4E:
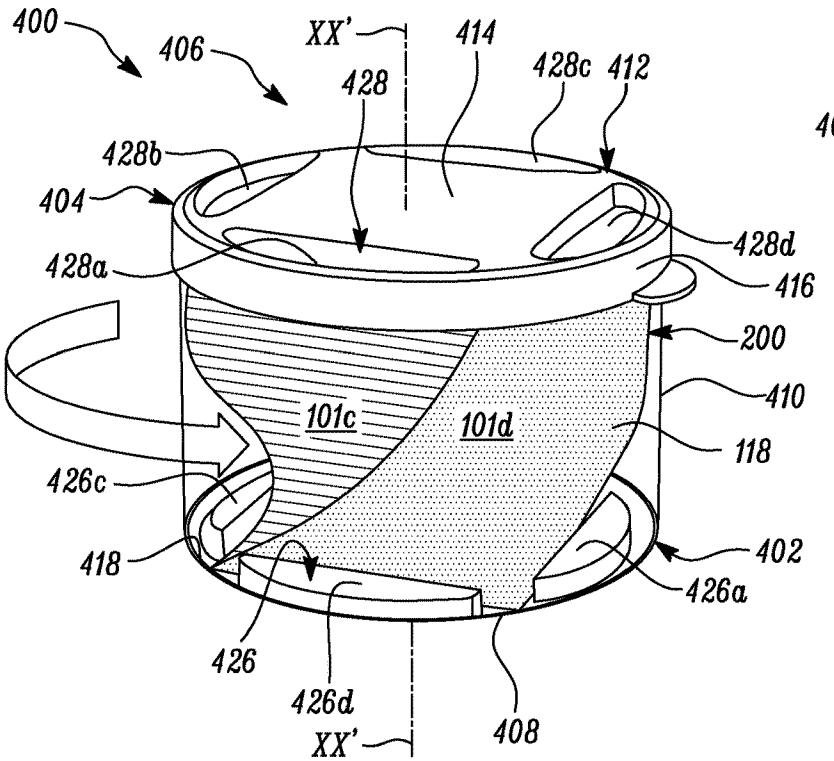

Although the foregoing sequence of FIGS. 4C through 4D has been explained for producing the spiral-shaped notepad of FIG. 2, the disclosed sequence is non-limiting of the present disclosure. Prior to the curing of the applied padding compound 118, if the first holding portion 402 and/or second holding portion 404 i.e., the base 408 and/or the lid 412 of the container 406 are continued to be rotated past the state depicted in the view of FIG. 4D, the cylindrical lip 416 of the lid 412 and the base 408 of the container 406 can be positioned in a state that is depicted in the view of FIG. 4E. The device 400 may be left to remain in this state i.e., with the relative positioning of the lid 412 and the base 408 depicted in the view of FIG. 4E for forming, for instance, the spiral-shaped notepad 300 of FIG. 3 in which the first and second distal portions 114, 116 of the stack 101 are offset from one another at the pre-determined angle of, for example, 90 degrees. By leaving the first and second holding portions 402, 404 to remain in their rotated positions, that are depicted in the view of FIG. 4E, for the pre-determined period of time, the padding compound 118 can cure and upon lapse of the pre-determined period of time, the cured padding compound 118 can help retain the spiral shape of the notepad and form the spiral-shaped notepad 300 of FIG. 3.

Although an operation of the device 400 is explained in conjunction with the views of FIGS. 4A-4D and FIGS. 4A-4E for producing the spiral-shaped notepads of FIGS. 2 and 3 respectively, such disclosure is merely illustrative in nature and hence, non-limiting of this disclosure. It may be noted that neither is the spiral-shaped notepad 200/300 limiting of this disclosure nor is the use of the device 400 for forming the spiral-shaped notepad 200/300 to be construed in the restrictive sense i.e., of being capable of producing only the spiral-shaped notepads 200 and 300 respectively. In fact, it will be appreciated that numerous other spiral-shaped notepads having their first and second distal portions 114, 116 offset at any pre-determined angle in the range of 1-359 degrees may be produced using the device 400.

Upon forming the spiral-shaped notepad, the first and second holding portions 402, 404 i.e., the base 408 and the lid 412 of the container 406 can be separated from one another for obtaining the spiral-shaped notepad from the device 400. This spiral-shaped notepad, obtained upon curing of the padding compound 118 within the device 400, is now ready for use by a user. As such upon packaging the spiral-shaped notepad using the device 400 for sale to a user, the user may obtain the spiral-shaped notepad by disengaging the cylindrical lip 416 of the lid 412 from the cylindrical wall 410 of the container 406, for example, by moving the lid 412 in a direction along, and about, the central axis XX' so as to separate the lid 412 from the container 406.

FIGS. 5A-5F show another exemplary embodiment of a device 500 for forming and holding a spiral-shaped notepad such as, for example, notepad 300 of FIG. 3. The device 500 includes a first holding portion 502 and a second holding portion 504. The first holding portion 502 is configured to hold the first distal portion 114 of the stack 101 and the second holding portion 504 is configured to hold the second distal portion 116 of the stack 101 as evident from the view of FIG. 5B. Moreover, in this embodiment, the first holding portion 502 and/or the second holding portion 504 are rotatable relative to one another about the central axis XX' for twisting the stack 101 about the central axis XX' and forming the spiral-shaped notepad 300 of FIG. 3.

Further, in this embodiment, an inner surface 518 of the first holding portion 502 includes a receptacle 520 that is configured to hold the first distal portion 114 of the stack 101 therein, and an inner surface 522 of the second holding portion 504 includes another receptacle 524 that is configured to hold the second distal portion 116 of the stack 101 therein. The receptacle 520 of the first holding portion 502 is bound by at least one protrusion 526 that is located on the inner surface 518 of the first holding portion 502. The receptacle 524 of the second holding portion 504 is bound by at least one other protrusion 528 that is located on the inner surface 522 of the second holding portion 504. In the illustrated embodiment of FIGS. 5A-5F, the at least one protrusion 526 on the inner surface 518 of the first holding portion 502 includes a single contiguous protrusion 532 that is arranged in a quadrilateral configuration about the central axis XX' to correspond with the four sides of the stack 101. Similarly, the at least one protrusion 528 on the inner surface 522 of the second holding portion 504 includes another single contiguous protrusion 534 that is arranged in a quadrilateral configuration about the central axis XX' to correspond with the four sides of the stack 101. However, in embodiments where the sheets 102 of the stack 101 are characterized with a perimeter edge of another polygonal shape, for example, a pentagonal shape, the contiguous protrusion 532, 534 on the inner surfaces 518, 522 of corresponding ones of the first and second holding portions 502, 504 may be rendered in a configuration that conforms to a shape of the stack 101. Alternatively, multiple discreet protrusions (not shown) may be arranged about the central axis XX'. For instance, the first holding portion 502 may include four protrusions and the second holding portion 504 may include another four protrusions such as that disclosed in conjunction with the first and second holding portions 502, 504 from the device 400 of the embodiment in the view of FIGS. 4A-4F. Such discreet protrusions from corresponding ones of the first and second holding portions 502, 504 may then be arranged in a quadrilateral configuration about the central axis XX' to correspond with a number of sides associated with the stack 101, in this case, the four sides 101*a*-101*d* of the stack 101. In yet another alternative embodiment, the first holding portion 502 may include two protrusions (not shown) while the second holding portion 504 may also include another two protrusions (not shown) to correspond with a pair of opposite sides of the stack 101. In other embodiments, fewer or more protrusions may be present in each of the first and second holding portions 502, 504 to correspond with one or more pre-determined number of sides 101*a*-101*d* of the stack 101.

Figure 5B:
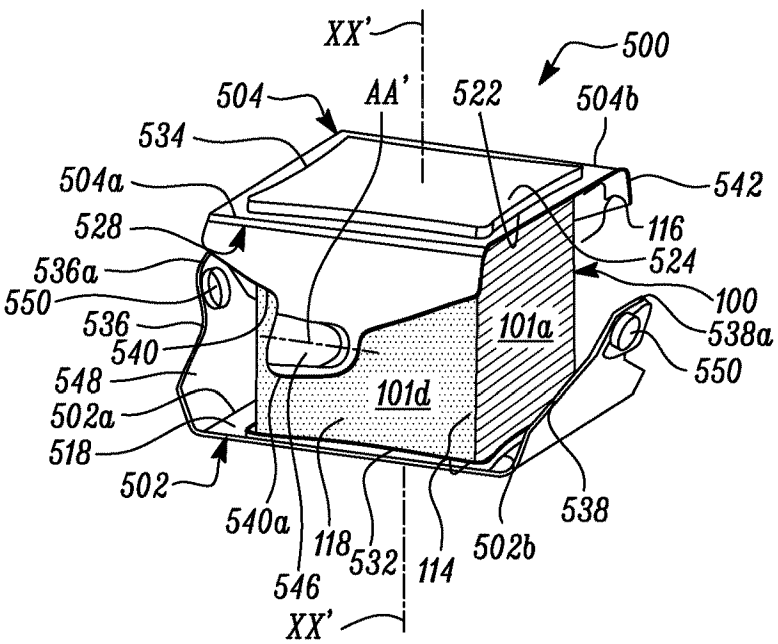
FIGS. 5A-5F are various schematic views of a device for forming and holding the spiral-shaped notepad of FIG. 3 according to one embodiment of the present disclosure.
Figure 5A:
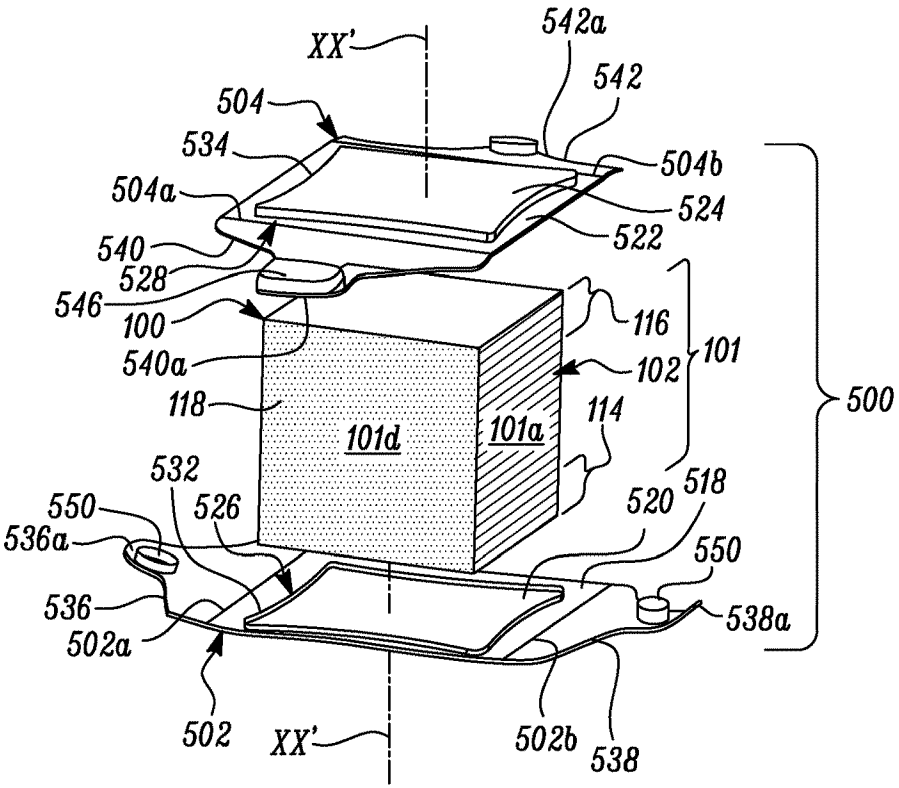

In some embodiments, a notepad (such as, for example, the notepad 100 of FIG. 1) may be received between the first and second holding portions 502, 504 of the device 500 as shown in the view of FIG. 5A. Specifically, the first distal portion 114 of the notepad may be positioned within the receptacle 520 of the first holding portion 502 and the second distal portion 116 of the notepad may be positioned within the receptacle 524 of the second holding portion 504. As disclosed earlier herein, the padding compound 118 is applied to the releasably bonded side i.e., the side 101*d* of the stack 101 that extends transversely between the first and second holding portions 502, 504. In some embodiments, the padding compound 118 is applied to the releasably bonded side of the stack 101 prior to positioning one or both of the first and distal portions of the notepad within the receptacles 520, 524 of the first and second holding portions 502, 504 respectively. In some embodiments, the padding compound 118 is applied to the releasably bonded side of the stack 101 after positioning one or both of the first and distal portions of the notepad within the receptacles 520, 524 of the first and second holding portions 502, 504 respectively.

Moreover, in this embodiment, the first and second holding portions 502, 504 are capable of being connected to each other. As shown in the illustrated embodiment of FIGS. 5A-5F, the device 500 includes a pair of first flaps 536, 538 extending laterally from a pair of opposite edges 502*a*, 502*b* of the first holding portion 502, and a pair of second flaps 540, 542 extending laterally from a pair of opposite edges 504*a*, 504*b* of the second holding portion 504. As shown best in the view of FIG. 5B, the first and second holding portions 502, 504 may be positioned in a pair of parallel planes to hold the first and second distal portions 114, 116 of the notepad via the corresponding receptacles 520, 524 of the first and second holding portions 502, 504. Further, the pair of first flaps 536, 538 associated with the first holding portion 502 and the pair of second flaps 540, 542 associated with the second holding portion 504 are angularly offset from one another by the pre-determined angle of 90 degrees for subsequently twisting the stack 101 as shown in the view of FIG. 5C until the first and second distal portions 114, 116 of the stack 101 are offset from one another by the pre-determined angle of 90 degrees, for producing the spiral-shaped notepad 300 of FIG. 3, as depicted in the view of FIG. 5D.

Figure 5D:
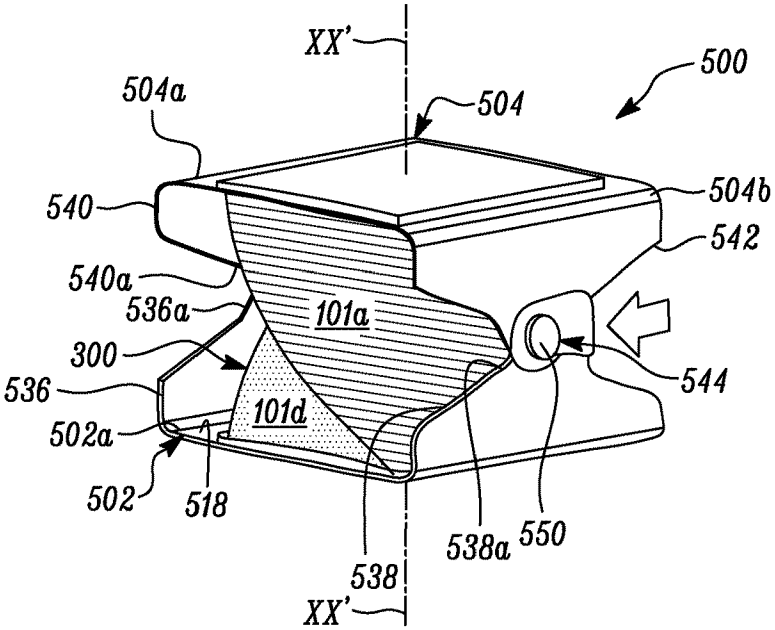
Figure 5C:
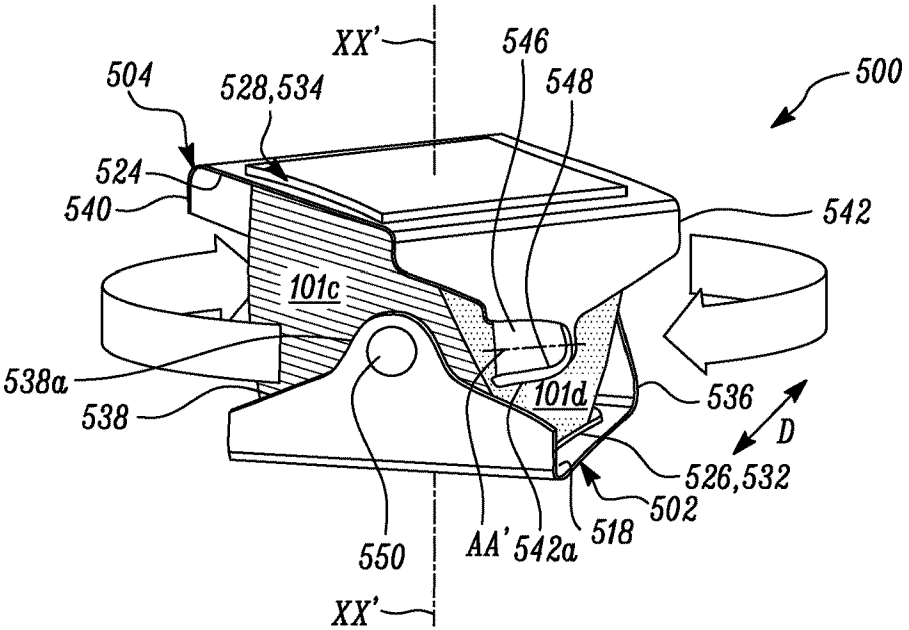

Corresponding ends 536*a*, 538*a* and 540*a*, 542*a* of the first and second flaps 536, 538 and 540, 542 are adapted to releasably secure the first holding portion 502 and the second holding portion 504 with each other as evident from the views of FIGS. 5C and 5D. Specifically, in this embodiment, the corresponding ends 536*a*, 538*a* and 540*a*, 542*a* of the first and second flaps 536, 538 and 540, 542 together define an interlocking tongue and groove joint 544 upon coupling. For instance, as shown best in the view of FIG. 5A, each end 540*a*, 542*a* from the second pair of flaps 540, 542 associated with the second holding portion 504 may define a groove 546 having a detent 548 therein and each end 536*a*, 538*a* of the first pair of flaps 536, 538 associated with the first holding portion 502 may define a locking member 550 that is configured to releasably engage with the groove 546, and in particular, with the detent 548 of the groove 546. In order to couple the first and second flaps 536, 538 and 540, 542 for causing formation of the interlocking tongue and groove joint 544 depicted in the view of FIG. 5D, the first holding portion 502 and/or the second holding portion 504 may be rotated relative to one another about the central axis XX' for bringing the corresponding ends 536*a*, 538*a* and 540*a*, 542*a* of the pairs of first and second flaps 536, 538 and 540, 542 together as shown best in the view of FIG. 5C. Upon rotating the first holding portion 502 and/or the second holding portion 504 relative to one another about the central axis XX' to the pre-determined angle of 90 degrees, the first and second distal portions 114, 116 of the stack 101 may also be twisted about the central axis XX' for forming the spiral notepad of FIG. 3, as shown in the view of FIG. 5D. Concomitantly, as the locking member 550 from each first flap 536, 538 is moved to engage with the groove 546 and subsequently moves into a position that is located past the detent 548, the first and second holding portions 502, 504 may be secured to one another. Once secured, the first and second holding portions 502, 504 may be maintained in their rotated positions for a pre-determined amount of time that is sufficient for the applied padding compound 118 to cure. Upon curing of the padding compound 118, the notepad retains its spiral shape and forms the spiral-shaped notepad depicted in the view of FIG. 3.

Figure 5F:
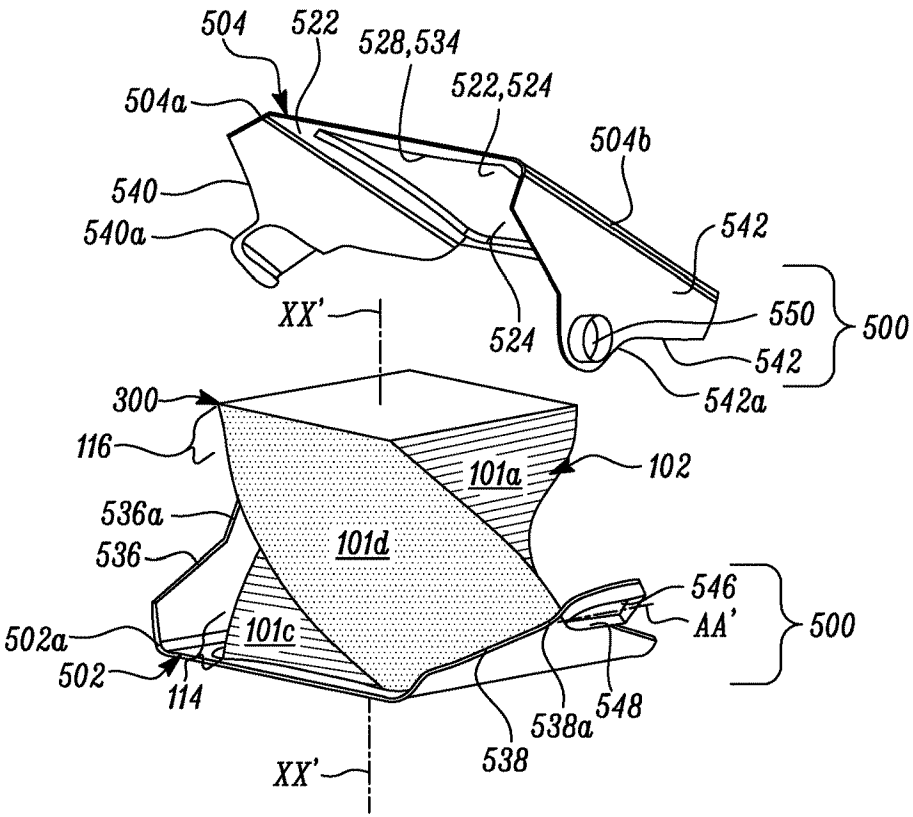
Figure 5E:
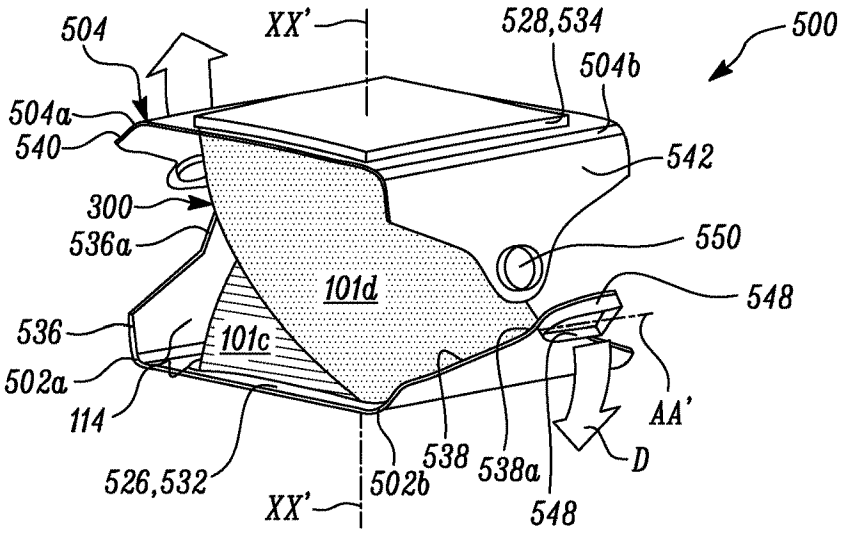

The first and second holding portions 502, 504 may be disconnected from one another for obtaining the spiral-shaped notepad 300 from the device 500. This spiral-shaped notepad 300, obtained upon curing of the padding compound 118 within the device 500, is now ready for use by a user. As such upon packaging the spiral-shaped notepad 300 using the device 500 for sale to a user, the user may obtain the spiral-shaped notepad 300 by disengaging the locking member 550 from the groove 546 and in particular, from the detent 548 of the groove 546, for example, by moving the locking member 550 in a direction that is different from that used for engaging the locking member 550 with the groove 546. For instance, as shown best in the view of FIG. 5E, the locking member 550 may have to be moved in a direction D that is transverse to an axis AA' of the groove 546. In this manner, as best shown in the view of FIG. 5F, the first and second holding portions 502, 504 can be rendered independent of one another i.e., free from the securement previously established by the engagement of the locking member 550 and the detent 548 of the groove 546 that is shown in the view of FIG. 5D.

Referring to FIGS. 6A-6F, a device 600 for forming and holding the spiral-shaped notepad 300 of FIG. 3 is depicted in accordance with an embodiment of the present disclosure. As the device 600 of FIGS. 6A-6F is generally similar to the device 500 of FIGS. 5A-5F, components, elements or features that are similar between the device 600 and the device 500 will be annotated by similar numbers increased by 100. Further, for sake of brevity, detailed explanation will be made herein merely to the components, elements, or features of the device 600 that are different in nature to those present in the device 500 of FIGS. 5A-5F.

The device 600 includes a first holding portion 602 and a second holding portion 604. The first holding portion 602 is configured to hold the first distal portion 114 of the stack 101 and the second holding portion 604 is configured to hold the second distal portion 116 of the stack 101 as evident from the view of FIG. 6C. Moreover, in this embodiment, the first holding portion 602 and/or the second holding portion 604 are rotatable relative to one another about the central axis XX' for twisting the stack 101 about the central axis XX' and for forming the spiral-shaped notepad 300 of FIG. 3 as depicted by the views of FIGS. 6C through 6F.

Further, in this embodiment, an inner surface 618 of the first holding portion 602 includes a receptacle 620 that is configured to hold the first distal portion 114 of the stack 101 therein, and an inner surface 622 of the second holding portion 604 includes another receptacle 624 that is configured to hold the second distal portion 116 of the stack 101 therein. The receptacle 620 of the first holding portion 602 is bound by at least one protrusion 626 that is located on the inner surface 618 of the first holding portion 602. The receptacle 624 of the second holding portion 604 is bound by at least one other protrusion 628 that is located on the inner surface 622 of the second holding portion 604. In the illustrated embodiment of FIGS. 6A-6F, the at least one protrusion 626 on the inner surface 618 of the first holding portion 602 includes a single contiguous protrusion 632 that is arranged in a quadrilateral configuration about the central axis XX' to correspond with the four sides of the stack 101. Similarly, the at least one protrusion 628 on the inner surface 622 of the second holding portion 604 includes another single contiguous protrusion 634 that is arranged in a quadrilateral configuration about the central axis XX' to correspond with the four sides of the stack 101.

Figure 6B:
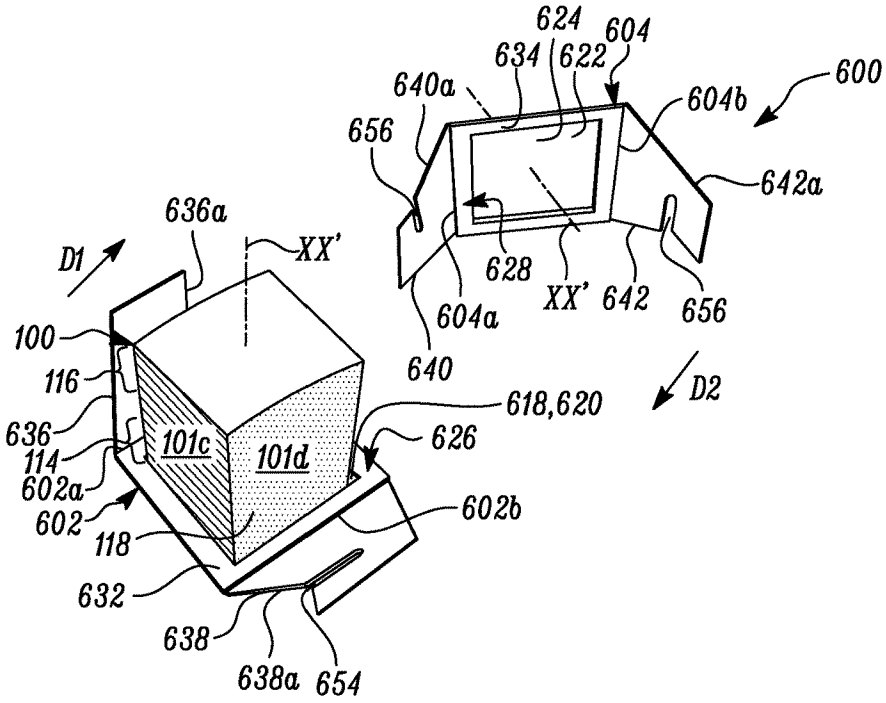
FIGS. 6A-6F are various schematic views of a device for forming and holding the spiral-shaped notepad of FIG. 3 according to one embodiment of the present disclosure.
Figure 6A:
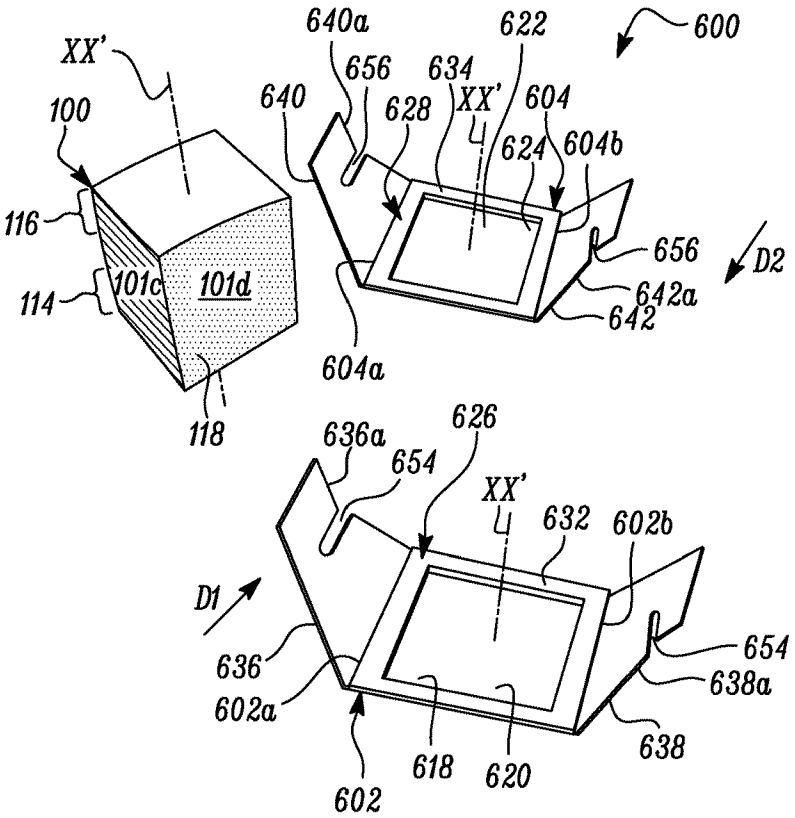
Figure 6D:
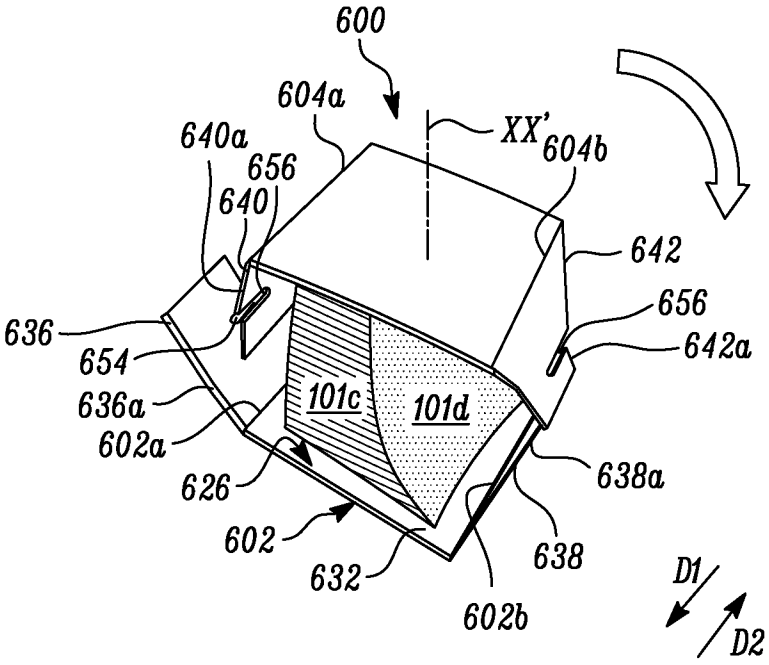
Figure 6C:
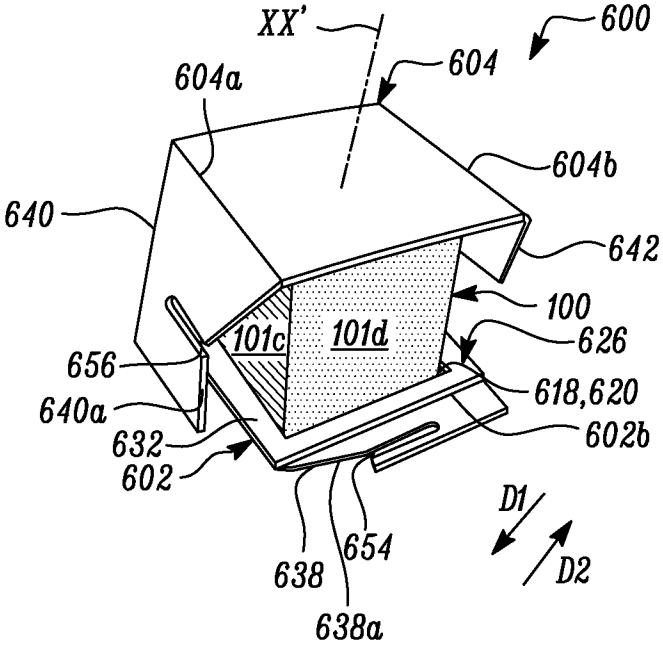

Moreover, in this embodiment, the first and second holding portions 602, 604 are capable of being connected to each other. As shown in the illustrated embodiment of FIGS. 6A-6F, the device 600 includes a pair of first flaps 636, 638 extending laterally from a pair of opposite edges 602*a*, 602*b* of the first holding portion 602, and a pair of second flaps 640, 642 extending laterally from a pair of opposite edges 604*a*, 604*b* of the second holding portion 604. As shown best in the view of FIG. 6C, the first and second holding portions 602, 604 may be positioned in a pair of parallel planes to hold the first and second distal portions 114, 116 of the notepad 100 via the corresponding receptacles 620, 624 of the first and second holding portions 602, 604. Further, the pair of first flaps 636, 638 associated with the first holding portion 602 and the pair of second flaps 640, 642 associated with the second holding portion 604 are angularly offset from one another by the pre-determined angle of 90 degrees for subsequently twisting the stack 101 as shown in the view of FIG. 6C until the first and second distal portions 114, 116 of the stack 101 are offset from one another by the pre-determined angle of 90 degrees, for producing the spiral-shaped notepad 300 of FIG. 3, as depicted in the view of FIG. 6D.

Figure 6F:
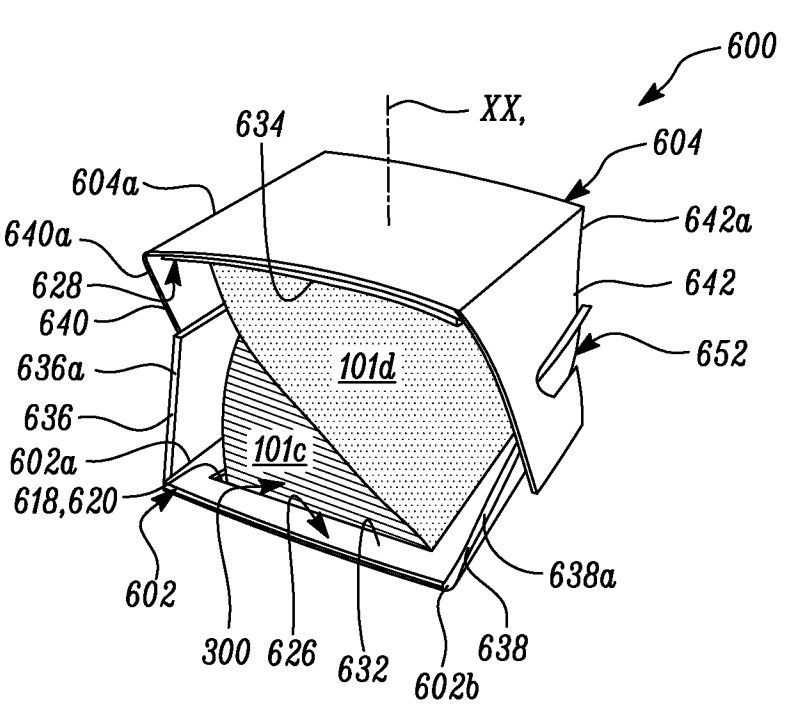
Figure 6E:
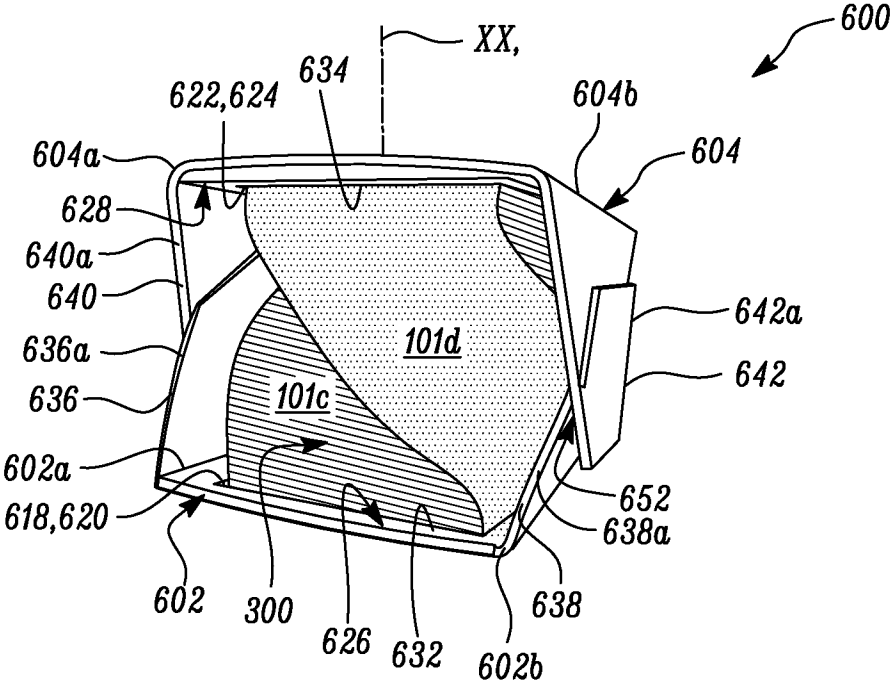

Corresponding ends 636*a*, 638*a* and 640*a*, 642*a* of the first and second flaps 636, 638 and 640, 642 are adapted to releasably secure the first holding portion 602 and the second holding portion 604 with each other as evident from the views of FIGS. 6E and 6F. Specifically, in this embodiment, the corresponding ends 636*a*, 638*a* and 640*a*, 642*a* of the first and second flaps 636, 638 and 640, 642 together define an interlocking cross lap joint 652 upon coupling as depicted in the views of FIGS. 6E and 6F. For instance, as shown best in the view of FIG. 6A, each end 636*a*, 638*a* from the first pair of flaps 636, 638 associated with the first holding portion 602 may define a first recess 654 that extends in a first direction D1 transverse to the central axis XX', for example, a clockwise direction about the central axis XX'. Similarly, each end 640*a*, 642*a* from the second pair of flaps 640, 642 associated with the second holding portion 604 may define a second recess 656 that extends in a second direction D2 that is opposite to the first direction D1, for example, in a counterclockwise direction about the central axis XX'. In order to couple the first and second flaps 636, 638 and 640, 642 for causing formation of the interlocking cross lap joint 652 depicted in the views of FIGS. 6E and 6F, the first holding portion 602 and/or the second holding portion 604 may be rotated relative to one another about the central axis XX' for bringing the corresponding ends 636*a*, 638*a* and 640*a*, 642*a* of the first and second flaps 636, 638 and 640, 642 together as shown best in the view of FIG. 6D. Upon rotating the first holding portion 602 and/or the second holding portion 604 relative to one another about the central axis XX' to the pre-determined angle of 90 degrees, the first and second distal portions 114, 116 of the stack 101 may also be twisted about the central axis XX' for forming the spiral-shaped notepad 300 of FIG. 3, as shown in the view of FIG. 6D. Concomitantly, as the pairs of first and second of flaps 636, 638 and 640, 642 are moved to engage via the first and second recesses 654, 656, the first and second holding portions 602, 604 may be secured to one another. Once secured, the first and second holding portions 602, 604 may be maintained in their rotated positions for a pre-determined amount of time that is sufficient for the applied padding compound 118 to cure. Upon curing of the padding compound 118, the notepad retains its spiral shape and forms the spiral-shaped notepad depicted in the view of FIG. 3.

The first and second holding portions 602, 604 may be disconnected from one another for obtaining the spiral-shaped notepad 300 from the device 600. The spiral-shaped notepad 300, obtained upon curing of the padding compound 118 within the device 600, is now ready for use by a user. As such, upon packaging the spiral-shaped notepad 300 using the device 600 for sale to a user, the user may obtain the spiral-shaped notepad by disengaging the at least one set of the engaged first and second flaps 636, 640 or 638, 642, for example, by moving the at least one set of engaged first and second flaps 636, 640 or 638, 642 in a direction that is different from that used for engaging the at least one set of engaged first and second flaps 636, 640 or 638, 642. For instance, the at least one set of engaged first and second flaps 636, 640 or 638, 642 may have to be moved partway along a direction that is parallel to the central axis XX' yet in a manner so as to rotate the at least one set of engaged first and second flaps 636, 640 or 638, 642 about the central axis XX' in a direction that is reverse to that used for engaging the at least one set of engaged first and second flaps 636, 640 or 638, 642. In this manner, the first and second holding portions 602, 604 can be rendered independent of one another i.e., free from the securement previously established by the engagement of corresponding sets of the first and second flaps 636, 640 and 638, 642 that is shown in the views of FIGS. 6E and 6F.

Referring to FIGS. 7A-7E, a device 700 for holding the spiral-shaped notepad 300 of FIG. 3 is depicted in accordance with an embodiment of the present disclosure. As the device 700 of FIGS. 7A-7E is generally similar to the device 600 of FIGS. 6A-6F, components, elements or features that are similar between the device 700 and the device 600 will be annotated by similar numbers increased by 100. Further, for sake of brevity, detailed explanation will be made herein merely to the components, elements, or features of the device 700 that are different in nature to those present in the device 600 of FIGS. 6A-6F.

The device 700 includes a first holding portion 702 and a second holding portion 704. The first holding portion 702 is configured to hold the first distal portion 114 of the stack 101 and the second holding portion 704 is configured to hold the second distal portion 116 of the stack 101 as evident from the views of FIGS. 7B and 7D respectively. In this embodiment, an inner surface 718 of the first holding portion 702 includes a receptacle 720 that is configured to hold the first distal portion 114 of the stack 101 therein, and an inner surface 722 of the second holding portion 704 includes another receptacle 724 that is configured to hold the second distal portion 116 of the stack 101 therein. The receptacle 720 of the first holding portion 702 is bound by at least one protrusion 726 that is located on the inner surface 718 of the first holding portion 702. The receptacle 724 of the second holding portion 704 is bound by at least one other protrusion 728 that is located on the inner surface 722 of the second holding portion 704. Specifically, in the illustrated embodiment of FIG. 7A, the at least one protrusion 726 on the inner surface 718 of the first holding portion 702 includes a single contiguous protrusion 732 that is arranged in a quadrilateral configuration about the central axis XX' to correspond with the four sides of the stack 101. Similarly, the at least one protrusion 728 on the inner surface 722 of the second holding portion 704 includes another single contiguous protrusion 734 that is arranged in a quadrilateral configuration about the central axis XX' to correspond with the four sides 101*a*-101*d* of the stack 101.

Further, in this embodiment, the first holding portion 702 and/or the second holding portion 704 are integrally formed with and capable of being connected to one another, as will be explained hereinafter. As shown in the illustrated embodiment of FIGS. 7A-7E, the device 700 includes an interconnecting member 758 that extends between proximal edges 702*a*, 704*a* of the first and second holding portions 702, 704. This interconnecting member 758 is foldable relative to the first and second holding portions 702, 704 along the pair of proximal edges 702*a*, 704*a* for moving the first and second holding portions 702, 704 inwardly or outwardly relative to each other. Moreover, the device 700 also includes a pair of overhangs 760, 762 that extend from distal edges 702*b*, 704*b* of the first and second holding portions 702, 704. The pair of overhangs 760, 762 are configured to releasably couple with each other via a fastening mechanism 764. In this embodiment, the fastening mechanism 764 includes at least one snap joint 766. Referring to the views of FIGS. 7A-7E, the fastening mechanism 764 is shown to include a pair of snap joints 766. However, in alternative configurations, fewer or more snap joints 766 may be implemented for releasably securing the first and second holding portions 702, 704 to one another.

Figure 7A:
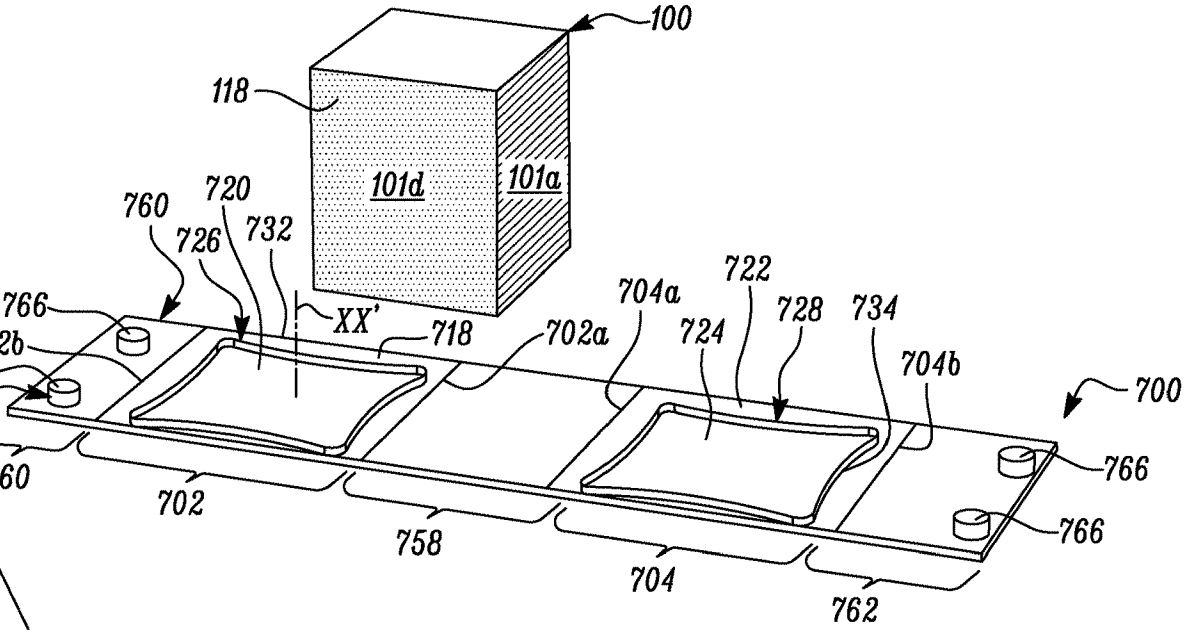
FIGS. 7A-7E are various schematic views of a device for holding the spiral-shaped notepad of FIG. 3 according to one embodiment of the present disclosure.
Figure 7B:
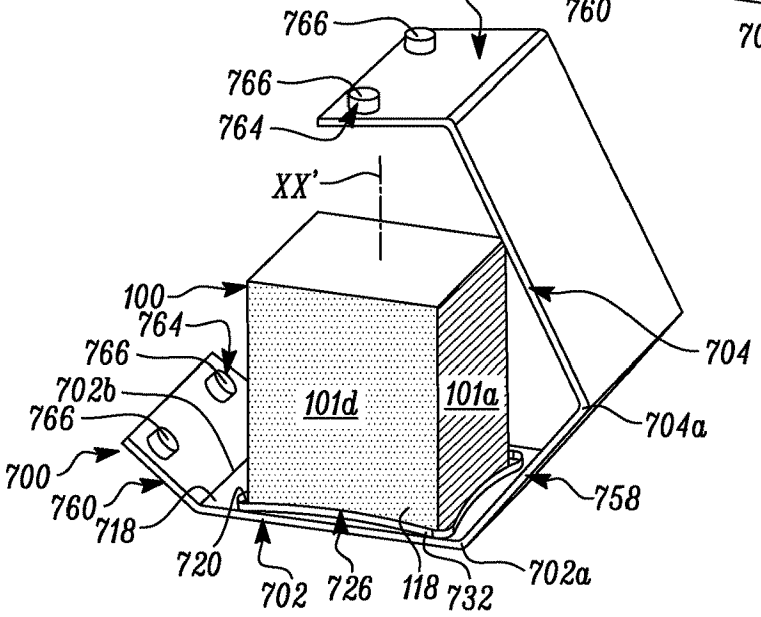
Figure 7D:
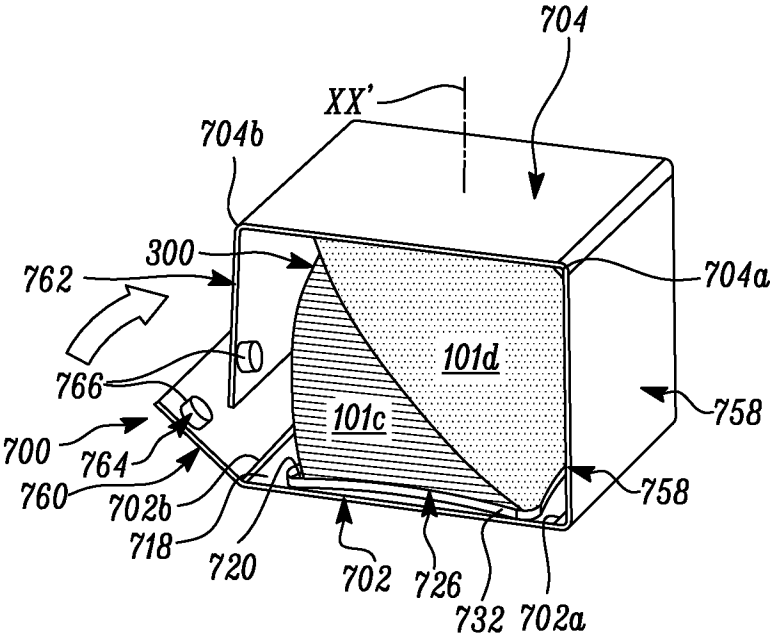
Figure 7C:
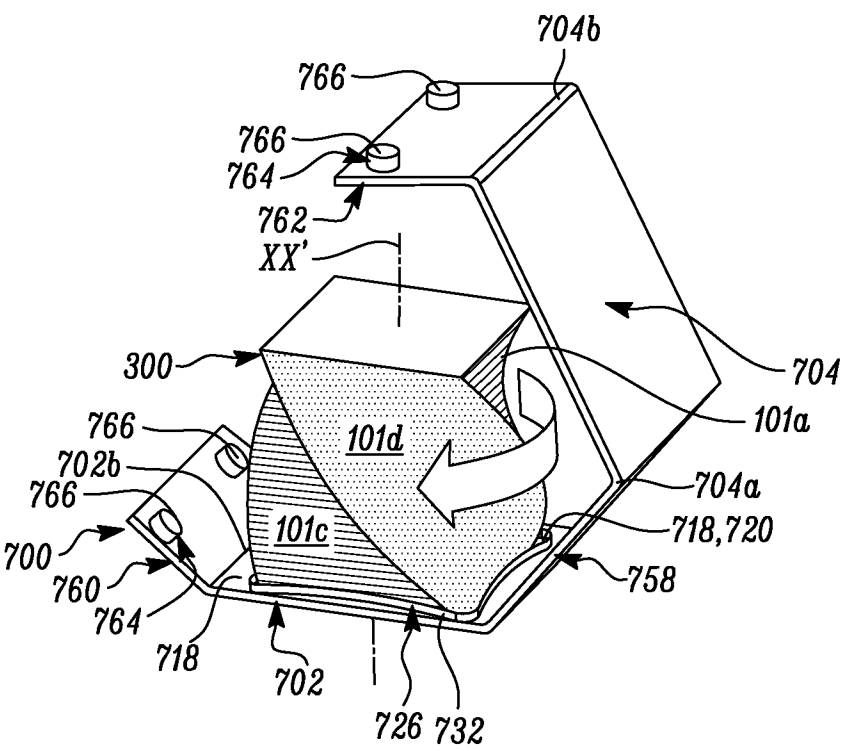
Figure 7E:
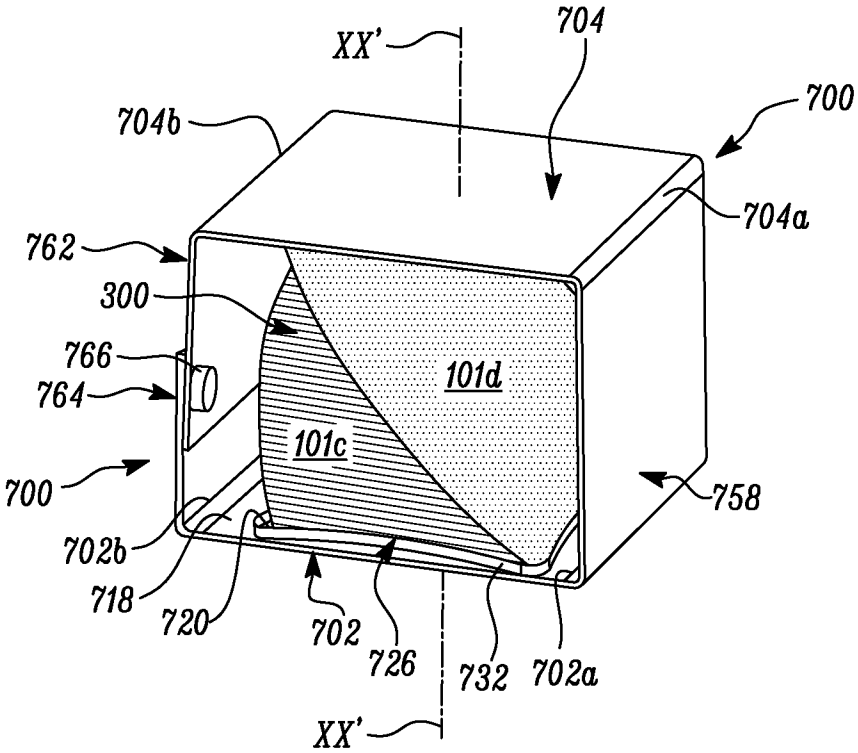

Furthermore, in this embodiment, the spiral shape of the notepad is obtained by positioning the first distal portion 114 of the stack 101 into the receptacle 720 of the first holding portion 702, as shown in the view of FIG. 7B, and subsequently twisting the stack 101 about the central axis XX' such that distally located sheets 102, or stated differently, the first and second distal portions 114, 116 of the stack 101 are rotated relative to each other by a pre-determined angle as depicted in the view of FIG. 7C. It may be noted that the padding compound 118 is applied to the releasably bonded side, i.e., the side 101*d* of the stack 101 extending transversely between the first and second holding portions 702, 704 prior to twisting the stack 101 about the central axis XX', and preferably, prior to positioning the first distal portion 114 of the stack 101 into the receptacle 720 of the first holding portion 702. Moreover, in this embodiment, the step of twisting of the stack 101 about the central axis XX' is accomplished manually, i.e., by manufacturing personnel, or by a machine (not shown) using an automated process, for example, in a manufacturing facility. Upon twisting the stack 101 about the central axis XX', the second distal portion 116 of the stack 101 is positioned into the receptacle 724 of the second holding portion 704. Thereafter, the first and second holding portions 702, 704 are secured to each other using the fastening mechanism 764, in this case, the pair of snap joints 766 as shown best in the view of FIG. 7D. Once secured, the first and second holding portions 702, 704 may be maintained in their secured positions, as shown in the view of FIG. 7E, for a pre-determined amount of time that is sufficient for the applied padding compound 118 to cure. Upon curing of the padding compound 118, the notepad retains its spiral shape and forms the spiral-shaped notepad 300 depicted in the view of FIG. 3.

The first and second holding portions 702, 704 may be disconnected from one another for obtaining the spiral-shaped notepad from the device 700. This spiral-shaped notepad, obtained upon curing of the padding compound 118 within the device 700, is now ready for use by a user. As such, upon packaging the spiral-shaped notepad using the device 700 for sale to a user, the user may obtain the spiral-shaped notepad by disengaging corresponding portions of each snap joint 766 from each other to release the pair of overhangs 760, 762 from securement. In this manner, the first and second holding portions 702, 704 can be disconnected from one another, i.e., free from the connection previously established by the engaged corresponding portions of the snap joints 766 from the pair of overhangs 760, 762.

Referring to FIGS. 8A-8F, a device 800 for holding the spiral-shaped notepad 300 of FIG. 3 is depicted in accordance with an embodiment of the present disclosure. As the device 800 of FIGS. 8A-8F is generally similar to the device 700 of FIGS. 7A-7E, components, elements or features that are similar between the device 800 and the device 700 will be annotated by similar numbers increased by 100. Further, for sake of brevity, detailed explanation will be made herein merely to the components, elements, or features of the device 800 that are different in nature to those present in the device 700 of FIGS. 7A-7E.

The device 800 includes a first holding portion 802 and a second holding portion 804. The first holding portion 802 is configured to hold the first distal portion 114 of the stack 101 and the second holding portion 804 is configured to hold the second distal portion 116 of the stack 101, as evident from the views of FIGS. 8B and 8D respectively. In this embodiment, an inner surface 818 of the first holding portion 802 includes a receptacle 820 that is configured to hold the first distal portion 114 of the stack 101 therein, and an inner surface 822 of the second holding portion 804 includes another receptacle 824 that is configured to hold the second distal portion 116 of the stack 101 therein. The receptacle 820 of the first holding portion 802 is bound by at least one protrusion 826 that is located on the inner surface 818 of the first holding portion 802. The receptacle 824 of the second holding portion 804 is bound by at least one other protrusion 828 that is located on the inner surface 822 of the second holding portion 804. Specifically, in the illustrated embodiment of FIG. 8A, the at least one protrusion 826 on the inner surface 818 of the first holding portion 802 includes a single contiguous protrusion 832 that is arranged in a quadrilateral configuration about the central axis XX' to correspond with the four sides of the stack 101. Similarly, the at least one protrusion 828 on the inner surface 822 of the second holding portion 804 includes another single contiguous protrusion 834 that is arranged in a quadrilateral configuration about the central axis XX' to correspond with the four sides of the stack 101.

Further, in this embodiment, the first holding portion 802 and/or the second holding portion 804 are integrally formed with and capable of being connected to one another, as will be explained hereinafter. As shown in the illustrated embodiment of FIGS. 8A-8F, the device 800 includes an interconnecting member 858 that extends between proximal edges 802*a*, 804*a* of the first and second holding portions 802, 804. This interconnecting member 858 is foldable relative to the first and second holding portions 802, 804 along the pair of proximal edges 802*a*, 804*a* for moving the first and second holding portions 802, 804 inwardly or outwardly relative to each other. Moreover, the device 800 also includes a pair of overhangs 860, 862 that extend from distal edges 802*b*, 804*b* of the first and second holding portions 802, 804. The pair of overhangs 860, 862 are configured to releasably couple with each other via a fastening mechanism 864. In this embodiment, the fastening mechanism 864 includes a hook and loop fastener 866, also commonly known and sold under the trademark name Velcro®. As best shown in the view of FIG. 8D, the fastening mechanism 864 is shown to include a first portion 866*a* of the hook and loop fastener 866 affixed to an outer surface 860*a* of the overhang 860 that extends from the distal edge 802*b* of the first holding portion 802 and a second portion 866*b* of the hook and loop fastener 866 affixed to an inner surface 862*b* of the overhang 862 that extends from the distal edge 804*b* of the second holding portion 804. Although one hook and loop fastener 866 is shown in the view of FIG. 8D, in alternative configurations, more than one hook and loop fastener 866 may be implemented for releasably securing the first and second holding portions 802, 804 to one another.

Figure 8A:
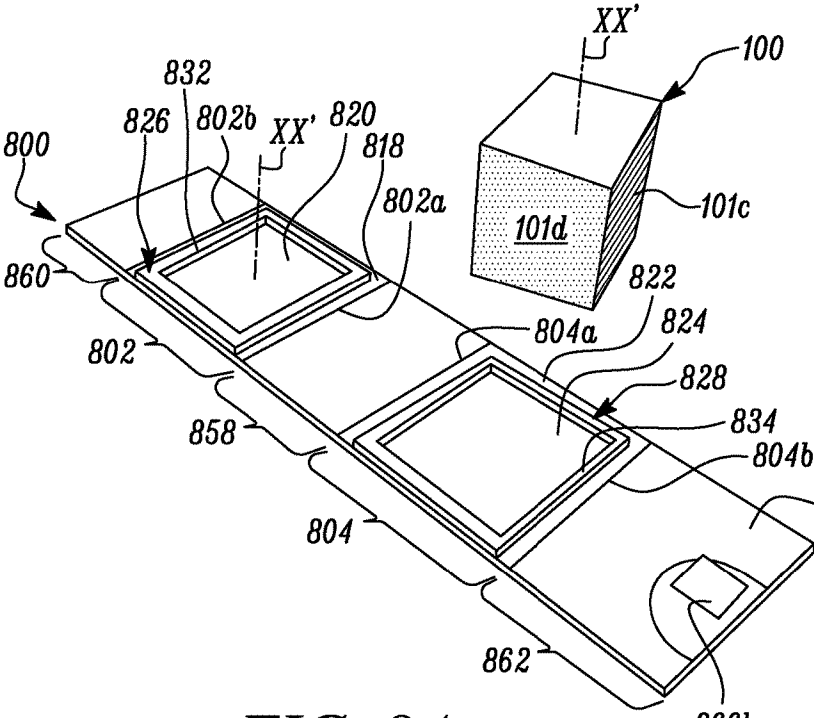
FIGS. 8A-8E are various schematic views of another device for holding the spiral-shaped notepad of FIG. 3 according to one embodiment of the present disclosure.
Figure 8B:
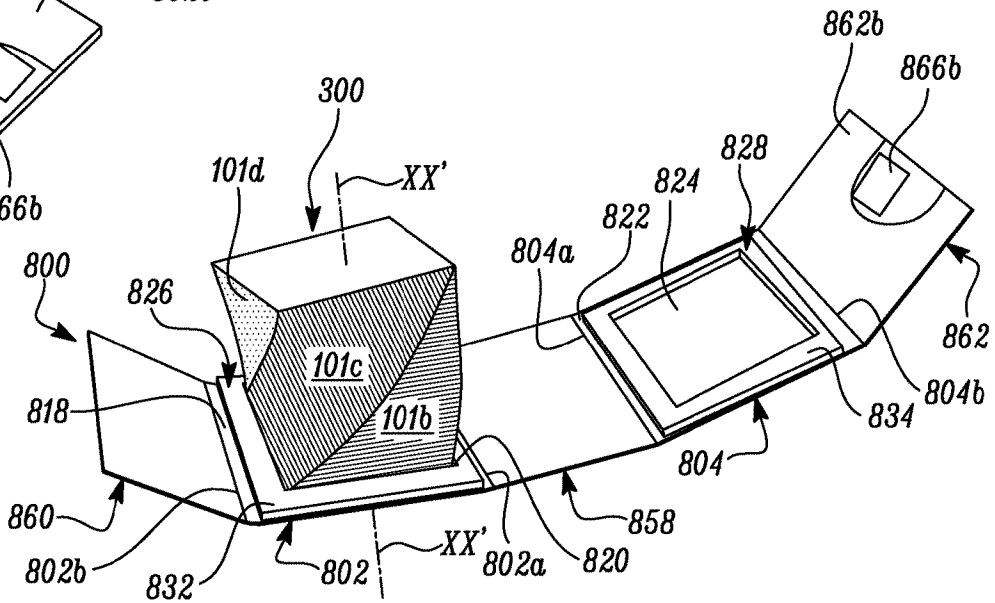
Figure 8D:
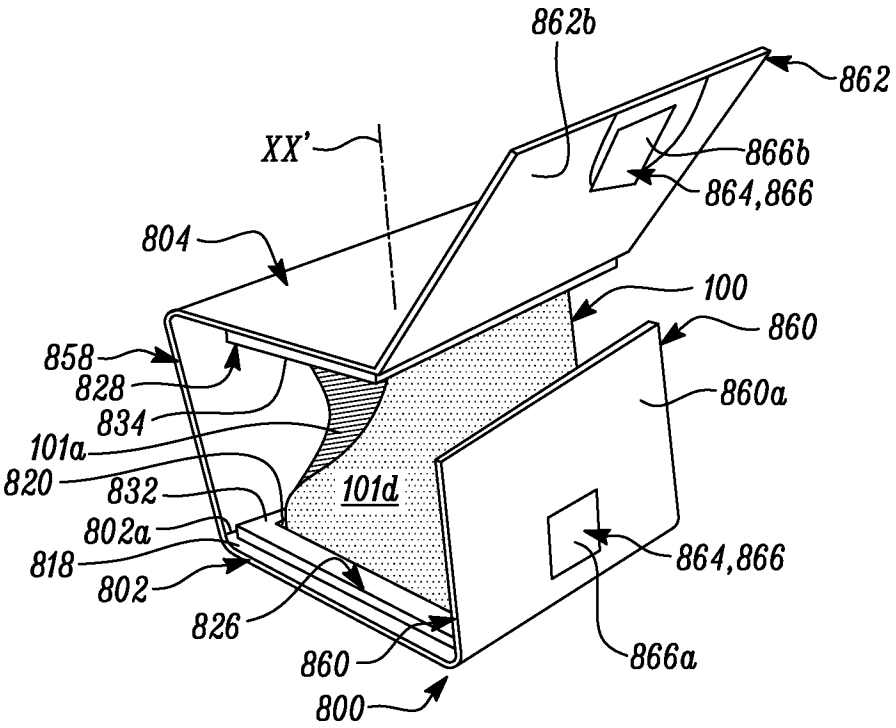
Figure 8C:
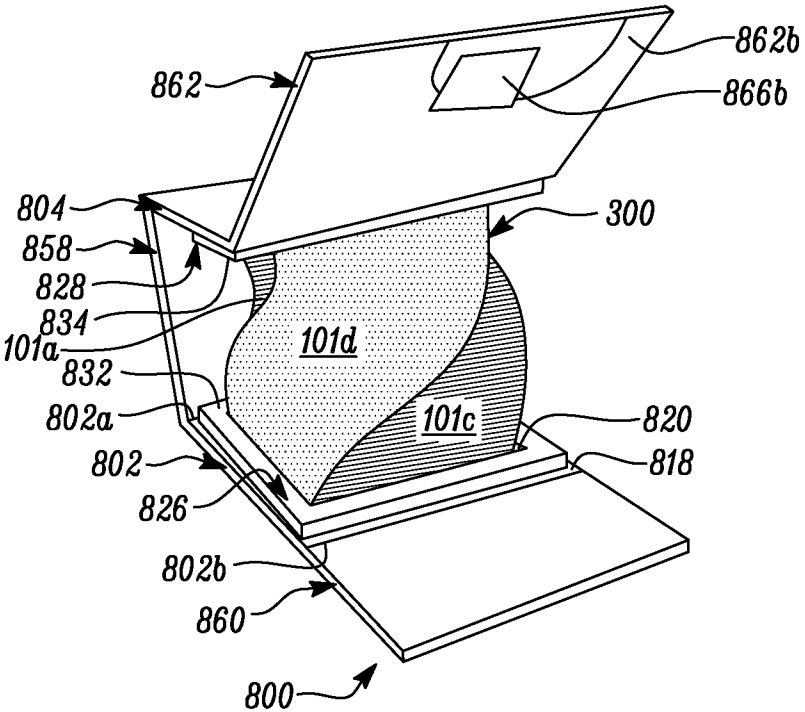
Figure 8E:
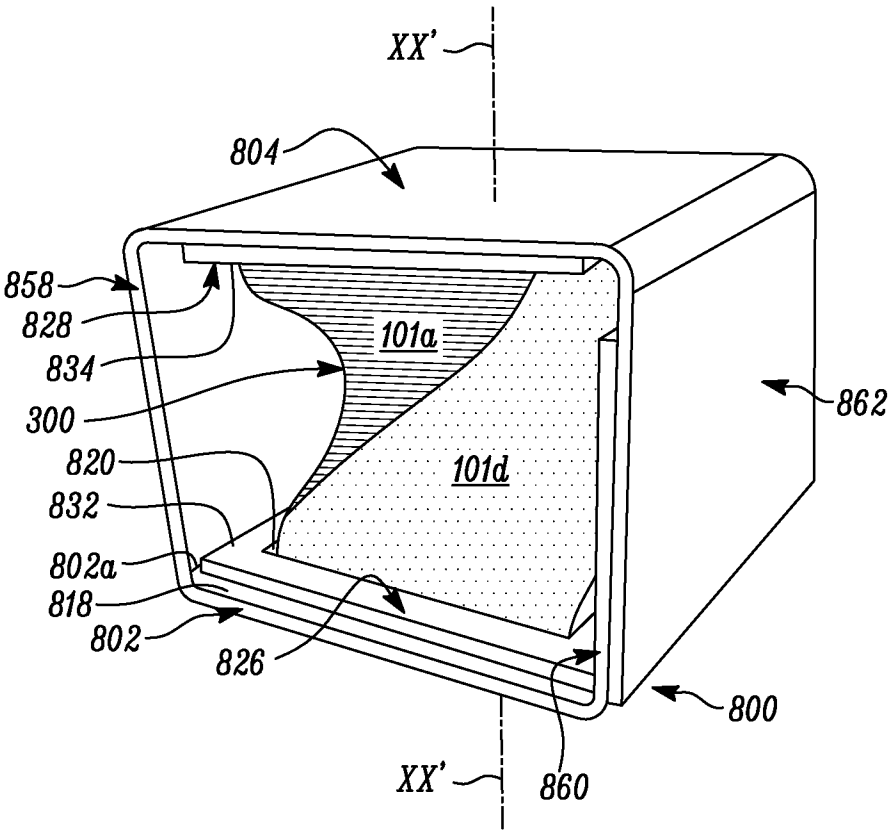

Furthermore, in this embodiment, the spiral shape of the notepad is obtained by positioning the first distal portion 114 of the stack 101 into the receptacle 820 of the first holding portion 802, as shown in the view of FIG. 8B, and subsequently twisting the stack 101 about the central axis XX' such that distally located sheets 102, or stated differently, the first and second distal portions 114, 116 of the stack 101 are rotated relative to each other by a predetermined angle as depicted in the view of FIG. 8B. It may be noted that the padding compound 118 is applied to a releasably bonded side, i.e., side 101*d* of the stack 101 extending transversely between the first and second holding portions 802, 804 prior to twisting the stack 101 about the central axis XX', and preferably, prior to positioning the first distal portion 114 of the stack 101 into the receptacle 820 of the first holding portion 802. Moreover, in this embodiment, the step of twisting the stack 101 about the central axis XX' is accomplished manually, i.e., by manufacturing personnel, or alternatively by a machine (not shown) that uses an automated process, for example, in a manufacturing facility. Upon twisting the stack 101 about the central axis XX', the second distal portion 116 of the stack 101 is positioned into the receptacle 824 of the second holding portion 804 as shown in the view of FIG. 8C. Thereafter, the first and second holding portions 802, 804 may be secured to each other using the fastening mechanism 864, in this case, by engaging the first and second portions 866*a*, 866*b* of the hook and loop fastener 866 as shown best in the view of FIG. 8D. Once the first and second holding portions 802, 804 are secured to each other as shown in the view of FIG. 8E, the first and second holding portions 802, 804 may be maintained in their secured positions for a pre-determined amount of time that is sufficient for the applied padding compound 118 to cure. Upon curing of the padding compound 118, the notepad retains its spiral shape and forms the spiral-shaped notepad depicted in the view of FIG. 3.

The first and second holding portions 802, 804 may be disconnected from one another for obtaining the spiral-shaped notepad from the device 800. This spiral-shaped notepad, obtained upon curing of the padding compound 118 within the device 800, is now ready for use by a user. As such, upon packaging the spiral-shaped notepad using the device 800 for sale to a user, the user may obtain the spiral-shaped notepad by disengaging the first and second portions 866*a*, 866*b* of the hook and loop fastener 866 from each other to release the pair of overhangs 860, 862 from securement. In this manner, the first and second holding portions 802, 804 can be disconnected from one another, i.e., free from the connection previously established by the engaged first and second portions 866*a*, 866*b* of the hook and loop fastener 866.

Figure 9:
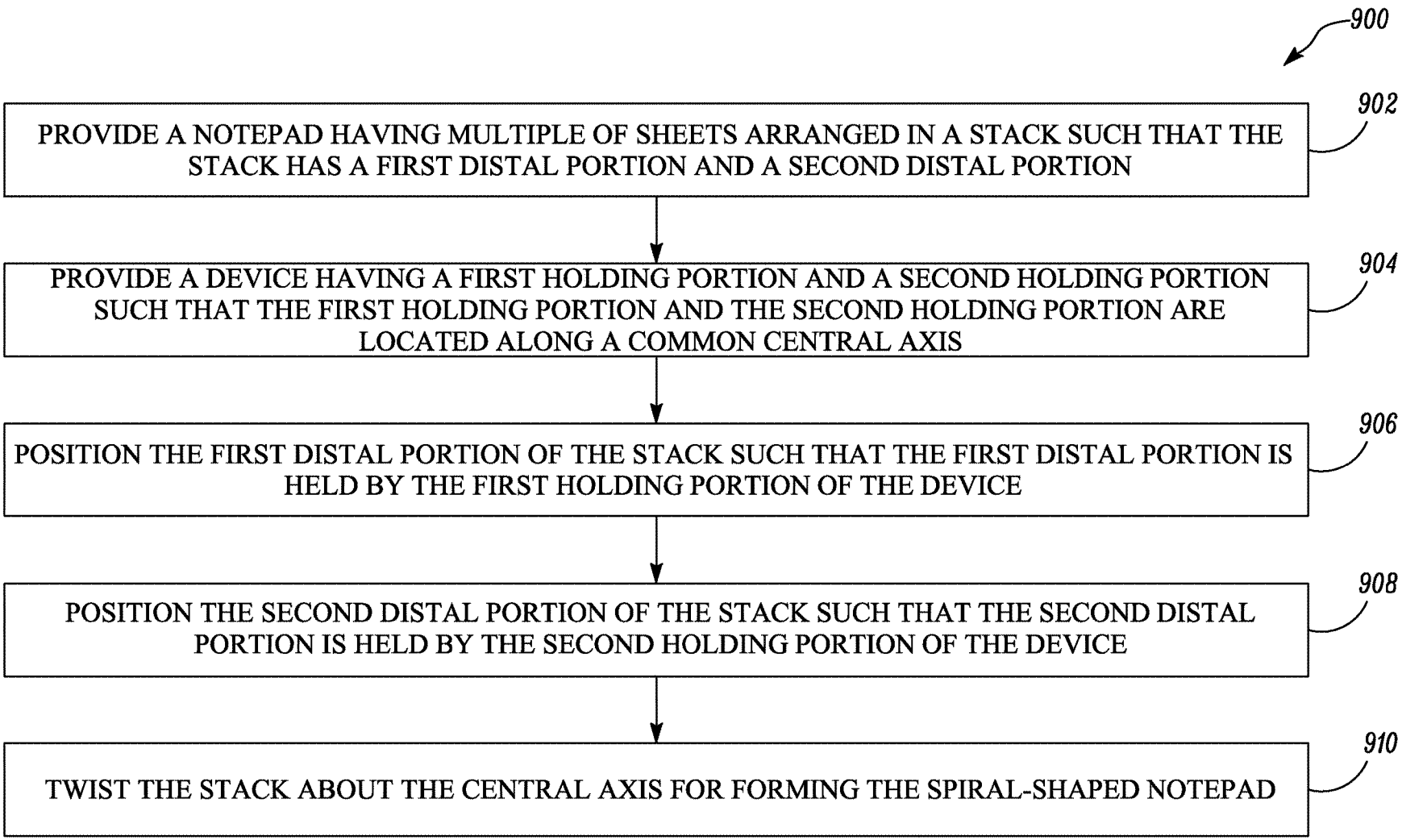
FIG. 9 is a flowchart of a method depicting steps for producing the spiral-shaped notepad of FIG. 2 or 3.

Referring to FIG. 9, a flowchart of a method 900 for producing a spiral-shaped notepad 200/300 is depicted. As shown at step 902, the method 900 includes providing a notepad, such as the notepad 100 having multiple sheets 102 that are arranged into a stack 101 such that the stack 101 has a first distal portion 114 and a second distal portion 116 (refer to the view of FIG. 1).

As shown at step 904, the method 900 further includes providing a device that has a first holding portion and a second holding portion such that the first holding portion and the second holding portion are located along a common central axis XX'. Referring to the embodiment of FIGS. 4A-4F, the device 400 has the first holding portion 402 and the second holding portion 404 that can be positioned and hence, located along the common central axis XX'. Similarly, in the embodiment of FIGS. 5A-5F, the device 500 has the first holding portion 502 and the second holding portion 504 that can be positioned and hence, located along the common central axis XX'. Similarly, in the embodiment of FIGS. 6A-6F, the device 600 has the first holding portion 602 and the second holding portion 604 that can be positioned and hence, located along the common central axis XX'. Similarly, in the embodiment of FIGS. 7A-7E, the device 700 has the first holding portion 702 and the second holding portion 704 that can be positioned and hence, located along the common central axis XX'. Similarly, in the embodiment of FIGS. 8A-8E, the device 800 has the first holding portion 802 and the second holding portion 804 that can be positioned and hence, located along the common central axis XX'.

As shown at step 906, the method 900 further includes positioning the first distal portion 114 of the notepad 100 such that the first distal portion 114 is held by the first holding portion of the device. Referring to the embodiment of FIGS. 4A-4F, the first distal portion 114 of the notepad 100 is positioned such that the first distal portion 114 is held by the first holding portion 402 of the device 400. Similarly, in the embodiment of FIGS. 5A-5F, the first distal portion 114 of the notepad 100 is positioned such that the first distal portion 114 is held by the first holding portion 502 of the device 500. Similarly, in the embodiment of FIGS. 6A-6F, the first distal portion 114 of the notepad 100 is positioned such that the first distal portion 114 is held by the first holding portion 602 of the device 600. Similarly, in the embodiment of FIGS. 7A-7E, the first distal portion 114 of the notepad 100 is positioned such that the first distal portion 114 is held by the first holding portion 702 of the device 700. Similarly, in the embodiment of FIGS. 8A-8E, the first distal portion 114 of the notepad 100 is positioned such that the first distal portion 114 is held by the first holding portion 802 of the device 800.

As shown at step 908, the method 900 also includes positioning the second distal portion 116 of the notepad 100 such that the second distal portion 116 is held by the second holding portion of the device. Referring to the embodiment of FIGS. 4A-4F, the second distal portion 116 of the notepad 100 is positioned such that the second distal portion 116 is held by the second holding portion 404 of the device 400, as shown best in the view of FIG. 4C. Similarly, in the embodiment of FIGS. 5A-5F, the second distal portion 116 of the notepad 100 is positioned such that the second distal portion 116 is held by the second holding portion 504 of the device 500, as shown best in the view of FIG. 5B. Similarly, in the embodiment of FIGS. 6A-6F, the second distal portion 116 of the notepad 100 is positioned such that the second distal portion 116 is held by the second holding portion 604 of the device 600, as shown best in the view of FIG. 6C. Similarly, in the embodiment of FIGS. 7A-7E, the second distal portion 116 of the notepad 100 is positioned such that the second distal portion 116 is held by the second holding portion 704 of the device 700, as shown best in the view of FIG. 7D. Similarly, in the embodiment of FIGS. 8A-8E, the second distal portion 116 of the notepad 100 is positioned such that the second distal portion 116 is held by the second holding portion 804 of the device 800, as shown best in the view of FIG. 8C.

Further, as shown at step 910, the method 900 also includes twisting the notepad 100 about the central axis XX' for forming the spiral-shaped notepad 200/300. Referring to the embodiment of FIGS. 4A-4F, the first holding portion 402 and/or the second holding portion 404 are rotated relative to one another for twisting the notepad 100 about the central axis XX', as shown in the view of FIG. 4D, for forming the spiral-shaped notepad 200 as shown in the view of FIG. 4E, or for forming the spiral-shaped notepad 300 as shown in the view of FIG. 4F. Referring to the embodiment of FIGS. 5A-5F, the first holding portion 502 and/or the second holding portion 504 are rotated relative to one another for twisting the notepad 100 about the central axis XX', as shown in the view of FIG. 5C, for forming the spiral-shaped notepad 300 as shown in the view of FIG. 5D. Referring to the embodiment of FIGS. 6A-6F, the first holding portion 602 and/or the second holding portion 604 are rotated relative to one another for twisting the notepad 100 about the central axis XX', as shown in the view of FIG. 6D, for forming the spiral-shaped notepad 300 as shown in the views of FIGS. 6E-6F. Referring to the embodiment of FIGS. 7A-7E, the notepad 100 is twisted about the central axis XX', as shown in the view of FIG. 7C, for forming the spiral-shaped notepad 300 as shown in the view of FIG. 7E. Referring to the embodiment of FIGS. 8A-8E, the notepad 100 is twisted about the central axis XX', as shown in the view of FIG. 8B, for forming the spiral-shaped notepad 300 as shown in the view of FIG. 8E. As disclosed earlier herein, in the embodiments of FIGS. 7A-7E, and FIGS. 8A-8E respectively, the step 910 of twisting of the stack 101 about the central axis XX' is accomplished manually i.e., by manufacturing personnel, or by a machine (not shown) using an automated process, for example, in a manufacturing facility.

In embodiments of this disclosure, the method 900 further includes defining, on an inner surface of each of the first and second holding portions, a receptacle bound by at least two protrusions extending transversely from the inner surface of a corresponding one of the first and second holding portions. The pair of protrusions are located about the central axis XX'. Further, for executing the steps 904 and 906, the method further includes positioning each of the first and second distal portions 114, 116 of the stack 101 into the receptacle of a corresponding one of the first and second holding portions. In an embodiment, for instance, pursuant to the embodiment of FIGS. 4A-4F, the method 900 may include defining four discreet protrusions, for example, the four protrusions 426*a*-426*d* and 428*a*-428*d* on each of the first and second holding portions of the device, i.e., the first and second holding portions 402, 404 of the device 400 respectively. Moreover, the method 900 then includes arranging the four protrusions on each of the first and second holding portions in a quadrilateral configuration about the central axis.

With regards to the embodiments depicted in the views of FIGS. 4A-4F, FIGS. 5A-5F and FIGS. 6A-6F respectively, the logical sequence of execution of the steps 902-910 may be step 902, step 904, step 906, step 908, and thereafter step 910. Therefore, pursuant to the embodiments of FIGS. 4A-4F, FIGS. 5A-5F and FIGS. 6A-6F respectively, the method 900 may include performing the step 908 of positioning the second distal portion 116 of the stack 101 such that the second distal portion 116 is held by the second holding portion of the devices 400/500/600 prior to twisting the stack 101 about the central axis XX', i.e., the step 910 as in these embodiments the stack 101 is twisted about the central axis XX' by rotating the first holding portion and/or the second holding portion of the devices 400/500/600 relative to one another. Further, in these embodiments, the method 900 may also include, subsequently, securing the first and second holding portions to one another upon rotating the first holding portion and/or the second holding portion of the device 400/500/600 relative to one another and maintaining the first and second holding portions in their rotated positions for packaging the spiral-shaped notepad 200/300 for sale to a user.

Moreover, pursuant to the embodiment of FIGS. 4A-4F and in regard to step 904 of the method 900, where the device 400 is provided, the method 900 includes forming the first and second holding portions 402, 404 with the help of the container 406. As disclosed earlier herein, the container 406 has the base 408, the cylindrical wall 410 extending upwardly from the base 408, and the lid 412 having the end wall 414 and the cylindrical lip 416 depending downwardly from the end wall 414 such that the cylindrical lip 416 is configured to releasably engage with the cylindrical wall 410 of the container 406. Further, the lid 412 is rotatable in relation to the cylindrical wall 410 to twist the stack 101 about the central axis XX' for obtaining the spiral-shaped notepad 200/300. Furthermore, in this embodiment, the base 408 forms the first holding portion 402 while the lid 412, and in particular, the end wall 414 of the lid 412 forms the second holding portion 404.

In the method 900 set forth herein, steps 902-910 are outlined in one possible order of execution, but these steps 902-910 may be rearranged without departing from the spirit and scope of the present disclosure as set forth in the claims. For instance, in the embodiments of FIGS. 7A-7E and FIGS. 8A-8E respectively, the order of execution of the steps 902-910 may be step 902, step 904, step 906, step 910, and thereafter step 908. Therefore, with regard to the embodiments of FIGS. 7A-7E and FIGS. 8A-8E respectively, the method may include performing the step 910 of twisting the stack 101 about the central axis XX' prior to positioning the second distal portion 116 of the stack 101 such that the second distal portion 116 is held by the second holding portion of the device 700/800, i.e., the step 908. Further, in these embodiments, the method 900 may also include, subsequently, securing the first and second holding portions of the device 700/800 to one another upon twisting the stack 101 about the central axis XX', and maintaining the first and second holding portions of the device 700/800 in their secured positions for retaining the spiral shape of the notepad and for packaging the spiral-shaped notepad 300 for sale to the user.

In an embodiment herein, the method 900 also includes applying the padding compound 118 to the side 101*d* of the stack 101 extending transversely between the first and second holding portions of the device 400/500/600/700/ or 800 prior to twisting the stack 101 about the central axis XX'. Further, upon application of the padding compound 118, the method 900 further includes maintaining the stack 101 in its twisted state for a pre-determined amount of time that is sufficient for the padding compound 118 to cure and subsequently retain the spiral shape of the notepad i.e., for forming the spiral-shaped notepad 200/300. It may be noted that in embodiments herein, the step of applying the padding compound 118 to the side 101*d* of the stack 101 is performed prior to twisting the notepad 100. Preferably, the step of applying the padding compound 118 to the side 101*d* of the stack 101 is performed prior to positioning the second distal portion 116 of the notepad 110 such that the second distal portion 116 is held by the second holding portion of the device 400/500/600/700/800. Most preferably, this step of applying the padding compound 118 to the side 101*d* of the stack 101 may be performed prior to positioning the first distal portion 114 of the notepad 110 such that the first distal portion 114 is held by the first holding portion of the device 400/500/600/700/800. Further, in an embodiment, the method 900 also includes maintaining the stack 101 in its twisted state for a pre-determined amount of time that is sufficient for the padding compound to cure and subsequently retain the spiral shape of the notepad. For maintaining the stack 101 in its twisted state for the pre-determined amount of time, the method 900 further includes securing together the first and second holding portions of the device 400/500/600/700/800 for storing the spiral-shaped notepad 200/300 therebetween.

In some embodiments, for instance, pursuant to the embodiments of FIGS. 5A-5F and 6A-6F, the method 900 may further include providing a pair of first flaps extending laterally from a pair of opposite edges of the first holding portion 502/602 and a pair of second flaps extending laterally from a pair of opposite edges of the second holding portion 504/604 such that corresponding ends of the first and second flaps are adapted to releasably secure the first holding portion 502/602 and the second holding portion 504/604 with each other. In an embodiment, for instance, pursuant to the embodiment of FIGS. 5A-5F, the method 900 may further include coupling the corresponding ends of the first and second flaps to define an interlocking tongue and groove joint 544. In an embodiment, for instance, pursuant to the embodiment of FIGS. 6A-6F, the method 900 may further include coupling the corresponding ends of the first and second flaps to define an interlocking cross lap joint 652.

In some embodiments, for instance, pursuant to the embodiments of FIGS. 7A-7E and 8A-8E, the method 900 may further include providing the interconnecting member 758/858 extending between proximal edges of the first and second holding portions such that the interconnecting member 758/858 is foldable relative to the first and second holding portions along the pair of proximal edges for moving the first and second holding portions in one of inwardly and outwardly relative to each other. Further, the method 900 may also include providing a pair of overhangs 760, 762 or 860, 862 that extend laterally from distal edges of the first and second holding portions such that the pair of overhangs 760, 762 or 860, 862 are configured to releasably couple with each other with the help of a fastening mechanism 764/864. In an embodiment, for instance, pursuant to the embodiment of FIGS. 5A-5F, the method 900 may further include configuring the fastening mechanism 764 to include at least one snap joint 766. In another embodiment, for instance, pursuant to the embodiment of FIGS. 5A-5F, the method 900 may further include configuring the fastening mechanism 864 to include the hook and loop fastener 866.

The devices 400, 500, 600, 700, and 800 used in practice of the present disclosure may be made of any suitable material including, for example, thermoplastic polymeric materials, cardboard, and/or metal foil. In addition, the materials that may be used for the devices 400, 500, 600, 700, and 800 may be dimensionally stable, durable, and readily formable into the desired configuration. Preferably, the material includes a thermoplastic polymeric material that has a sufficient thickness and flexibility to permit it to be at least water resistant. Suitable thermoplastic polymeric materials include, but are not limited to, polyesters (e.g., glycol-modified polyethylene terephthalate, or polybutylene terephthalate), polycarbonate, polypropylene, polystyrene, polyvinyl chloride, acrylonitrile-butadiene-styrene, amorphous polyethylene terephthalate, polyamide, polyolefins (e.g., polyethylene, polybutene, or polyisobutene), modified poly(phenylene ether), polyurethane, 10 polydimethylsiloxane, acrylonitrile-butadiene-styrene resins, and polyolefin copolymers. In some embodiments, the material may have a melting temperature in the range of about 400° F. (204° C.) to about 630° F. (332° C.). The devices 400, 500, 600, 700, and 800 may be optically clear, or may be modified to be one of translucent and opaque through pigmentation.

The devices 400/500/600/700/800 of the present disclosure may have any dimensions suitable for use with notepads of various sizes and form factors as the protrusions 426, 428/526, 528/626, 628/726, 728/826, 828 from respective ones of the devices 400/500/600/700/800 may be spaced suitably from the central axis XX' for holding and/or forming specific sizes and form factors of spiral-shaped notepads 200/300.

With use of the device 400/500/600/700/800 herein, a lead time for producing the spiral-shaped notepad 200/300 may be reduced significantly, as the padding compound 118 applied to the notepad 100, prior to forming the spiral-shaped notepad 200/300, may now cure while the spiral-shaped notepad 200/300 is held within the device 400/500/600/700/800 before being sold to a user. As compared to conventionally produced notepads, use of the device 400/500/600/700/800 obviates the need for letting the unfinished notepad i.e., the spiral-shaped notepad 200/300 with the padding compound 118 yet to be cured fully, reside within a premise of a curing facility. Consequently, implementation of the device 400/500/600/700/800 in forming the spiral-shaped notepad 200/300 of the present disclosure may help manufacturing facilities to offset additional costs that was previously incurred in setting up and commissioning a curing facility, while also saving costs, time and effort that may have otherwise been incurred by letting the unfinished notepad reside at the manufacturing facility for curing of the padding compound. Therefore, with implementation of the device 400/500/600/700/800 together with the unfinished notepad, i.e., the spiral-shaped notepad 200/300 with the padding compound 118 yet to be cured fully, as a package that is intended for sale to the user, the padding compound 118 cures within the device 400/500/600/700/800 before sale to the user. For example, the padding compound 118 may cure during transit of the package from the manufacturing location to the user.

Also, by imparting a spiral-shape to the notepad 200/300 of the present disclosure, it is hereby contemplated that the spiral shape of the notepad 200/300 helps to render the spiral-shaped notepad 200/300 with an improved visual appeal as compared to conventionally designed notepads. Moreover, edges of individual sheets 102 of the spiral-shaped notepad 200/300 do not align with one another. This renders the notepad 200/300 with an improved form factor, as compared to conventional designs of notepads, as users may now find it relatively easier to pick and separate individual sheets 102, owing to the non-aligned edges of the individual sheets 102, from the notepad 200/300 of the present disclosure. Therefore, users may need less effort and deftness of the fingers to pick and separate each individual sheet 102 from the notepad 200/300 of the present disclosure.

Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

The invention claimed is:

1. A notepad comprising:

a plurality of sheets arranged into a stack, each sheet having a first major face and a second major face, each of the first and second major faces terminating at a perimeter edge; and an adhesive disposed on at least a portion of the second major face of each sheet such that the portion of the second major face of each sheet releasably adheres to a corresponding portion of the first major face of an underlying sheet, wherein the adhesive on the portion of the second major face lies at least partially adjacent to a portion of the perimeter edge of a corresponding sheet, the portion of the perimeter edge of each sheet forming a releasably bonded side of the stack; and wherein the stack is twisted about a common central axis of the plurality of sheets present therein such that the notepad has a spiral shape.

2. The notepad of claim 1, wherein the stack is twisted about the central axis such that distally located sheets are rotated relative to each other by a predetermined angle.

3. The notepad of claim 1, further comprising:

a padding compound on the plurality of sheets of the stack, wherein the padding compound is on at least the portion of the perimeter edge of each sheet forming the releasably bonded side of the stack.

4. The notepad of claim 3, wherein the stack is maintained in its twisted state for a pre-determined amount of time, the pre-determined amount of time corresponding to at least a time duration sufficient to allow the padding compound to cure and subsequently retain the spiral shape of the notepad.

5. The notepad of claim 1, wherein the adhesive is disposed on 10% to 75% of a total surface area of the second major face of the sheet.

6. A device for holding a spiral-shaped notepad of claim 1, comprising:

a first holding portion that is configured to hold a first distal portion of the stack; and a second holding portion that is configured to hold a second distal portion of the stack, wherein the second holding portion is at least one of integrally formed with and capable of being connected to the first holding portion; and wherein the device is used in packaging the spiral-shaped notepad for sale to a user.

7. The device of claim 6, wherein the first holding portion and/or the second holding portion are rotated relative to one another about the central axis for twisting the stack about the central axis and forming the spiral-shaped notepad.

8. The device of claim 7, wherein the first holding portion and/or the second holding portion are rotatable relative to one another by at least 1 degree to 359 degrees.

9. The device of claim 6, wherein a padding compound is applied to a side of the stack extending transversely between the first and second holding portions prior to twisting the stack about the central axis.

10. The device of claim 6, wherein an inner surface of the first holding portion includes a receptacle that is configured to hold the first distal portion of the stack therein, and an inner surface of the second holding portion includes another receptacle that is configured to hold the second distal portion of the stack therein, and wherein the first and second holding portions, once connected to one another, are capable of maintaining the notepad in its spiral shape.

11. The device of claim 10, wherein:

each receptacle is bound by at least one protrusion located on the inner surface of a respective holding portion.

12. The device of claim 10, wherein the first holding portion and the second holding portion are together configured to form a container having:

a base for forming the first holding portion;

a cylindrical wall extending upwardly from the base; and a lid having:

an end wall for forming the second holding portion; and a cylindrical lip depending downwardly from the end wall; the cylindrical lip configured to releasably engage with the cylindrical wall of the container; and wherein the lid is rotatable in relation to the cylindrical wall to twist the stack about the central axis for obtaining the spiral-shaped notepad.

13. The device of claim 6 further comprising:

a pair of first flaps extending laterally from a pair of opposite edges of the first holding portion; and a pair of second flaps extending laterally from a pair of opposite edges of the second holding portion; wherein corresponding ends of the first and second flaps are adapted to releasably secure the first holding portion and the second holding portion with each other.

14. The device of claim 6 further comprising:

an interconnecting member extending between proximal edges of the first and second holding portions, the interconnecting member foldable relative to the first and second holding portions along the proximal edges for moving the first and second holding portions in one of inwardly and outwardly relative to each other.

15. The device of claim 6 further comprising:

a pair of overhangs extending from distal edges of the first and second holding portions, the pair of overhangs configured to releasably couple with each other via a fastening mechanism.

16. A method for producing a spiral-shaped notepad of claim 1, the method comprising:

providing a notepad having a plurality of sheets arranged in a stack, the stack having a first distal portion and a second distal portion;

providing a device comprising a first holding portion and a second holding portion such that the first holding portion and the second holding portion are located along a common central axis;

positioning the first distal portion of the stack such that the first distal portion is held by the first holding portion of the device;

positioning the second distal portion of the stack such that the second distal portion is held by the second holding portion of the device; and twisting the stack about the central axis for forming the spiral-shaped notepad.

17. The method of claim 16 further comprising performing the step of positioning the second distal portion of the stack such that the second distal portion is held by the second holding portion prior to twisting the stack about the central axis.

18. The method of claim 17 further comprising twisting the stack about the central axis by rotating the first holding portion and/or the second holding portion relative to one another.

* * * * *